US006895768B2

(12) United States Patent
Sakamoto et al.

(10) Patent No.: US 6,895,768 B2
(45) Date of Patent: May 24, 2005

(54) REFRIGERANT CIRCUIT

(75) Inventors: Shinichi Sakamoto, Kusatsu (JP); Hiroshi Nakayama, Kusatsu (JP); Mikihiko Kuroda, Kusatsu (JP); Yasuhiko Oka, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 66 days.

(21) Appl. No.: 10/479,597

(22) PCT Filed: May 31, 2002

(86) PCT No.: PCT/JP02/05337

§ 371 (c)(1),
(2), (4) Date: Dec. 4, 2003

(87) PCT Pub. No.: WO02/101304

PCT Pub. Date: Dec. 19, 2002

(65) Prior Publication Data

US 2004/0134225 A1 Jul. 15, 2004

(30) Foreign Application Priority Data

Jun. 11, 2001 (JP) ..... 2001-175670
Sep. 26, 2001 (JP) ..... 2001-293304

(51) Int. Cl.[7] ..... F25B 41/00; F25B 1/00

(52) U.S. Cl. ..... 62/196.4; 62/197; 62/498; 62/513

(58) Field of Search ..... 62/513, 113, 498, 62/196.4, 197, 509

(56) References Cited

U.S. PATENT DOCUMENTS 4,773,234 A * 9/1988 Kann ..... 62/513
5,245,833 A * 9/1993 Mei et al. ..... 62/113
6,009,715 A * 1/2000 Sakurai et al. ..... 62/197
6,189,334 B1 2/2001 Dienhart et al.
6,220,044 B1 * 4/2001 Sakurai et al. ..... 62/197
6,378,323 B1 * 4/2002 Chavagnat ..... 62/324.4
6,467,300 B1 * 10/2002 Noble, III ..... 62/472

FOREIGN PATENT DOCUMENTS

| | | |
|---|---|---|
| EP | 0779481 | 6/1997 |
| JP | 3-164661 | 7/1991 |
| JP | 6-23878 | 6/1994 |
| JP | 9-145184 | 6/1997 |
| JP | 2945364 | 6/1999 |
| JP | 2000-337722 | 12/2000 |

* cited by examiner

*Primary Examiner*—Marc Norman
(74) *Attorney, Agent, or Firm*—Shinjyu Global IP Counselors, LLP

(57) ABSTRACT

Disclosed is a refrigerant circuit which comprises a compressor (15), a water heat exchanger (16), a receiver (18), an expansion valve (19), and an evaporator (20). In the refrigerant circuit, a refrigerating cycle is carried out by compressing refrigerant to above a critical pressure in the compressor (15). A cooling section (17) for cooling refrigerant flowing out of the water heat exchanger (16) is provided on the upstream side of the receiver (18). A part of the evaporator (20) functions as an air heat exchanger which operates as the cooling section (17). The cooling section (17) exchanges heat with refrigerant on the outlet side of the evaporator (20).

6 Claims, 27 Drawing Sheets

REFRIGERANT CIRCUIT

TECHNICAL FIELD

This invention is directed to refrigerant circuits for use in heat source units of, for example, hot water supply apparatus of the heat pump type.

BACKGROUND ART

Referring first to FIG. 27, there is illustrated a commonly-used hot water supply apparatus of the heat pump type. This conventional hot water supply apparatus is made up of a tank unit 71 having a hot water storage tank 70, and a heat source unit 73 having a refrigerant circuit 72. The refrigerant circuit 72 is provided with a compressor 74, a condenser 75 which is a water heat exchanger, a receiver 76, an expansion valve 77, and an evaporator 78. On the other hand, the tank unit 71 is provided with the hot water storage tank 70 and a circulation path 79. A pump 80 and a heat exchange path 81 are inserted in the circulation path 79. In this case, the heat exchange path 81 is formed by the water heat exchanger 75.

Accordingly, when the compressor 74 is activated while the pump 80 is activated (operated), stored water (warm water) starts flowing into the circulation path 79 from a water intake port provided at the bottom of the hot water storage tank 70 and circulates through the heat exchanging path 81. At this time, the warm water is heated (boiled) by the condenser (water heat exchanger) 75 and is directed back to the upper part of the hot water storage tank 70 from a hot water supply port. Hereby, high temperature warm water is stored in the hot water storage tank 70.

Hitherto, as the refrigerant of a refrigerant circuit of the type describe above, various refrigerants, such as dichloro difluoro methane (R-12), chloro difluoro methane (R22) et cetera, have been used. However, alternative refrigerants, such as 1,1,1,2-tetra fluoro ethane (R-134a) et cetera, are now being used to cope with problems, e.g., ozone layer destruction and environmental pollution. However, the refrigerant R-134a is still problematic because it exhibits a high global warming potential. Accordingly, use of natural refrigerants free from these environmental problems has been recommended. The fact that super-critical refrigerants such as carbon dioxide gas are useful as natural refrigerant has been known in the art. By the term "super-critical refrigerant" used here is meant a refrigerant which performs a refrigerating cycle by compression to above a critical pressure in the compressor.

PROBLEMS TO BE SOLVED

Referring to FIG. 26, there is graphically shown the refrigerating cycle of a refrigerant circuit employing a super-critical refrigerant such as carbon dioxide gas. And now, when hot water (warm water) is being boiled, high temperature hot water (warm water) flows out into the circulation path if high temperature warm water is stored to the bottom of the hot water storage tank, with the result that the temperature of water entering into the water heat exchanger 75 rises. Such a rise in the temperature of water entering into the water heat exchanger 75 results in a refrigerating cycle shown by a solid line of FIG. 28. Consequently, the enthalpy difference becomes narrowed in a condensation process (heat liberation process), therefore resulting in the reduction in hot water supply capacity and COP (coefficient of performance).

In addition, as shown in FIG. 29, the rise in outside air temperature also causes the refrigerating cycle to become narrowed in operational range.

In other words, various circumstances cause variations in load on the condensation side (heat liberation side) and on the evaporation side. Such load variation causes a stable refrigerating cycle to undergo a change. Consequently, each refrigerating cycle requires a different amount of refrigerant from the other. Even if the refrigerant is charged for a certain refrigerating cycle, the refrigerating cycle will change depending on the operational status. As a result, the amount of charged refrigerant may be in excess or deficiency, and there is the possibility that the refrigerating cycle is not maintained adequately.

As described above, in a refrigerating cycle in which the refrigerant is compressed to above a critical pressure and high pressure becomes a so-called super-critical cycle, the refrigerant density variation in a super-critical zone becomes continuous. Therefore, conventional techniques find it difficult to deal with an excess refrigerant generated in an operational area of a different operational condition. If such an excess refrigerant is not dealt with, there is the possibility that wet operation is carried out. The wet operation causes the drop in discharge temperature of the compressor 74, with the result that the refrigeration effect is reduced and the COP falls. In order to solve these problems, the design pressure must be made higher, which is expensive.

The present invention was made to eliminate the above-described drawbacks. Accordingly, an object of the present invention is to provide a refrigerant circuit capable of maintaining the refrigerating cycle adequately in various operational situations.

DISCLOSURE OF INVENTION

Accordingly, a first invention provides a refrigerant circuit comprising a compressor 15, a radiator 16, a receiver 18, an expansion valve 19, and an evaporator 20, and in the refrigerant circuit the compressor (15) compresses refrigerant to above a critical pressure for performing a refrigerating cycle. And, a cooling section 17, for cooling a refrigerant flowing out of the radiator 16, is disposed on the upstream side of the receiver 18.

Stated another way, the first invention is directed to a refrigerant circuit which is made up of the foregoing components, i.e., the compressor 15, the radiator 16, the receiver 18, the expansion valve 19, and the evaporator 20. The refrigerant circuit of the first invention uses, as its refrigerant, a super-critical refrigerant used under super-critical conditions. The refrigerant circuit of the first invention is characterized in that the cooling section 17 capable of cooling a refrigerant flowing out of the radiator 16 is provided upstream of the receiver 18.

Since, in the refrigerant circuit of the first invention, refrigerant which flows into the receiver 18 is cooled in the cooling section 17, this makes it possible to store refrigerant, which has been cooled sufficiently enough to enter the high density state, in the receiver 18 even when various circumstances et. cetera cause variations in load on the side of the radiator 16 and on the side of the evaporator 20. This allows an adequate amount of refrigerant to circulate through the refrigerant circuit.

A second invention provides a refrigerant circuit which is characterized in that a part of the evaporator 20 functions as an air heat exchanger and the air heat exchanger operates as the cooling section 17.

In the refrigerant circuit of the second invention, the cooling section 17 is formed by a part of the evaporator 20, which eliminates the need for the provision of an additional heat exchanger, thereby making it possible to simplify the entire refrigerant circuit.

A third invention provides a refrigerant circuit which is characterized in that the cooling section 17 is operable to transfer heat between refrigerant flowing out of the radiator 16 and refrigerant on the outlet side of the evaporator 20.

In the refrigerant circuit of the third invention, refrigerant present on the outlet side of the evaporator 20 is low in temperature and pressure, thereby ensuring that refrigerant flowing into the receiver 18 is cooled by such a low temperature, low pressure refrigerant without fail.

A fourth invention provides a refrigerant circuit comprising a compressor (15), a radiator 16, a receiver 18, an expansion valve 19, and an evaporator 20. In the refrigerant circuit of the fourth invention, the compressor 15 compresses refrigerant to above a critical pressure for performing a refrigerating cycle. The refrigerant circuit of the fourth invention is characterized in that a heat exchange means 30 operable to transfer heat between high pressure refrigerant in the inside of the receiver 18 and low pressure refrigerant is provided.

Stated another way, the fourth invention is a refrigerant circuit which is made up of the aforesaid components, i.e., the compressor 15, the radiator 16, the receiver 18, the expansion valve 19, and the evaporator 20. The refrigerant circuit of the fourth invention uses, as its refrigerant, a super-critical refrigerant used under super-critical conditions. The refrigerant circuit of the fourth invention is characterized in that the heat exchange means 30 capable of transfer heat between a high pressure refrigerant within the receiver 18 and a low pressure refrigerant is provided.

In the refrigerant circuit of the fourth invention, it is ensured that refrigerant in the inside of the receiver 18 is cooled by low pressure refrigerant without fail. This makes it possible to promote the accumulating of refrigerant in the inside of the receiver 18, thereby preventing the receiver 18 from entering the excess refrigerant state. Contrary to the refrigerant in the inside of the receiver 18, the low pressure refrigerant is heated, thereby making it possible to prevent the compressor 15 from performing a wet operation.

A fifth invention provides a refrigerant circuit which is characterized in that the low pressure refrigerant is refrigerant on the inlet side of the evaporator 20.

In the refrigerant circuit of the fifth invention, refrigerant on the inlet side of the evaporator 20 is low in temperature and pressure, thereby ensuring that refrigerant within the receiver 18 is cooled by such a low temperature, low pressure refrigerant without fail.

A sixth invention provides a refrigerant circuit which is characterized in that the low pressure refrigerant is refrigerant on the outlet side of the evaporator 20.

In the refrigerant circuit of the sixth invention, refrigerant on the outlet side of the evaporator 20 is low in temperature and pressure, thereby ensuring that refrigerant within the receiver 18 is cooled by such a low temperature, low pressure refrigerant without fail.

A seventh invention provides a refrigerant circuit which is characterized in that a main path 54 through which high pressure refrigerant from the compressor 15, after having passed through the radiator 16, flows into the expansion valve 19, and a bypass circuit 55 through which high pressure refrigerant from the compressor 15 flows into the receiver 18 are provided, whereby refrigerant, the temperature of which is higher than the temperature of refrigerant on the outlet side of the radiator 16, flows into the receiver 18.

Stated another way, in the refrigerant circuit of the seventh invention, the aforesaid paths, i.e., the main path 54 through which high pressure refrigerant from the compressor 15, after having passed through the radiator 16, flows into the expansion valve 19 and the bypass circuit 55 through which high pressure refrigerant from the compressor 15 flows into the receiver 18, are provided, whereby refrigerant, the temperature of which is higher than the temperature of refrigerant on the outlet side of the radiator 16, flows into the receiver 18.

In the refrigerant circuit of the seventh invention, high pressure refrigerant flowing into the receiver 18 is refrigerant that passes through the bypass circuit 55, in other words, refrigerant, the temperature of which is higher than the temperature of refrigerant on the outlet side of the radiator 16, flows into the receiver 18. Hereby, it becomes possible to increase the temperature variation range of refrigerant in the inside of the receiver 18, and the refrigerant density difference for every operational area can be increased.

An eighth invention provides a refrigerant circuit which is characterized in that the bypass circuit 55 is provided with a throttle mechanism S.

In the refrigerant circuit of the eighth invention, the flow rate of refrigerant passing through the inside of the receiver 18 is varied by the throttle mechanism S. This ensures that excess refrigerant generated by the difference in operational condition is accumulated in the receiver 18 without fail, thereby making it possible to achieve improvements in excess refrigerant absorption capacity.

A ninth invention provides a refrigerant circuit comprising a compressor 15, a radiator 16, a receiver 18, an expansion valve 19, and an evaporator 20 in which refrigerant circuit the compressor 15 compresses refrigerant to above a critical pressure for performing a refrigerating cycle. And a bypass circuit 55 through which high pressure refrigerant from the compressor 15 flows into the receiver 18 is provided for transferring heat between high pressure refrigerant in the inside of the receiver 18 and low pressure refrigerant on the inlet side of the evaporator 20.

Stated another way, the refrigerant circuit of the ninth invention is a refrigerant circuit which comprises the aforesaid components, i.e., the compressor 15, the radiator 16, the receiver 18, the expansion valve 19, and the evaporator 20. The refrigerant circuit of the ninth invention uses, as its refrigerant, a super-critical refrigerant used under super-critical conditions. The refrigerant circuit of the ninth invention is characterized in that the bypass circuit 55 through which high pressure refrigerant from the compressor 15 flows into the receiver 18 is provided for transferring heat between high pressure refrigerant in the inside of the receiver 18 and low pressure refrigerant on the inlet side of the evaporator 20.

In the refrigerant circuit of the ninth invention, it is ensured that refrigerant within the receiver 18 is cooled by low pressure refrigerant without fail. This makes it possible to promote the accumulating of refrigerant in the inside of the receiver 18, thereby making it possible to prevent the receiver 18 from entering the excess refrigerant state.

A tenth invention provides a refrigerant circuit which is characterized in that a flow rate control valve 56 is disposed on the outlet side of the receiver 18.

In the refrigerant circuit of the tenth invention, it is possible to rise the refrigerant temperature and reduce the amount of refrigerant storage in the inside of the receiver 18 when the flow rate control valve 56 is fully opened. Additionally, at the time of the valve travel control of the flow rate control valve 56, it is possible to hold the refrigerant temperature at a required level and the amount of refrigerant storage in the inside of the receiver 18 is made adequate. When the flow rate control valve 56 is fully closed, it is possible to decrease the refrigerant temperature and increase the amount of refrigerant storage in the inside of the receiver 18.

EFFECTS OF INVENTION

In accordance with the refrigerant circuit of the first invention, even when there occur variations in load on the side of the radiator 16 and on the side of the evaporator 20, the amount of refrigerant circulating through the refrigerant circuit is maintained at adequate levels, with the result that stable operations are carried out and there is no drop in COP. Besides, the capacity of a receiver to be disposed can be set low, and the entire refrigerant circuit can be downsized and the cost of production can be reduced.

In accordance with the refrigerant circuit of the second invention, the need for the provision of an additional heat exchanger is eliminated, thereby making it possible to achieve simplification of the entire refrigerant circuit. Therefore, the cost of production is reduced to a further extent.

In accordance with the refrigerant circuit of the third invention, it is ensured that refrigerant entering into the receiver 18 is cooled without fail. This ensures that the refrigerating cycle is maintained adequately.

In accordance with the refrigerant circuit of the fourth invention, the amount of refrigerant circulating through the refrigerant circuit is made adequate, even under the condition that conventional refrigerant circuits undergo the excess refrigerant state. In other words, excess refrigerant generated by the difference in operational condition is dealt with in the refrigerant circuit of the fourth invention, thereby achieving improvements in COP and reducing costs. On the contrary, refrigerant on the low pressure side is heated. This prevents the compressor 15 from performing a wet compression operation, therefore improving the reliability of the compressor 15.

In accordance with the refrigerant circuit of the fifth or sixth invention, it is further ensured that excess refrigerant is dealt with, thereby achieving improvements in COP and reducing costs.

In accordance with the refrigerant circuit of the seventh invention, it is possible to increase the refrigerant density difference for every operational area. This increases the excess refrigerant absorption capacity, and the drop in refrigeration effect is prevented from occurring without fail, and the COP is improved.

In accordance with the refrigerant circuit of the eighth invention, it is ensured that the excess refrigerant absorption capacity is improved, and the refrigerant circuit is improved in reliability.

In accordance with the refrigerant circuit of the ninth invention, the amount of refrigerant circulating through the refrigerant circuit is made adequate, even under the condition that conventional refrigerant circuits undergo the excess refrigerant state. In other words, excess refrigerant generated by the difference in operational condition is dealt with in the refrigerant circuit of the ninth invention, thereby achieving improvements in COP and reducing costs.

Finally, in accordance with the refrigerant circuit of the tenth invention, it is ensured that excess refrigerant generated by the difference in operational condition is dealt with stably.

BEST MODE FOR CARRYING OUT INVENTION

Figure 1:
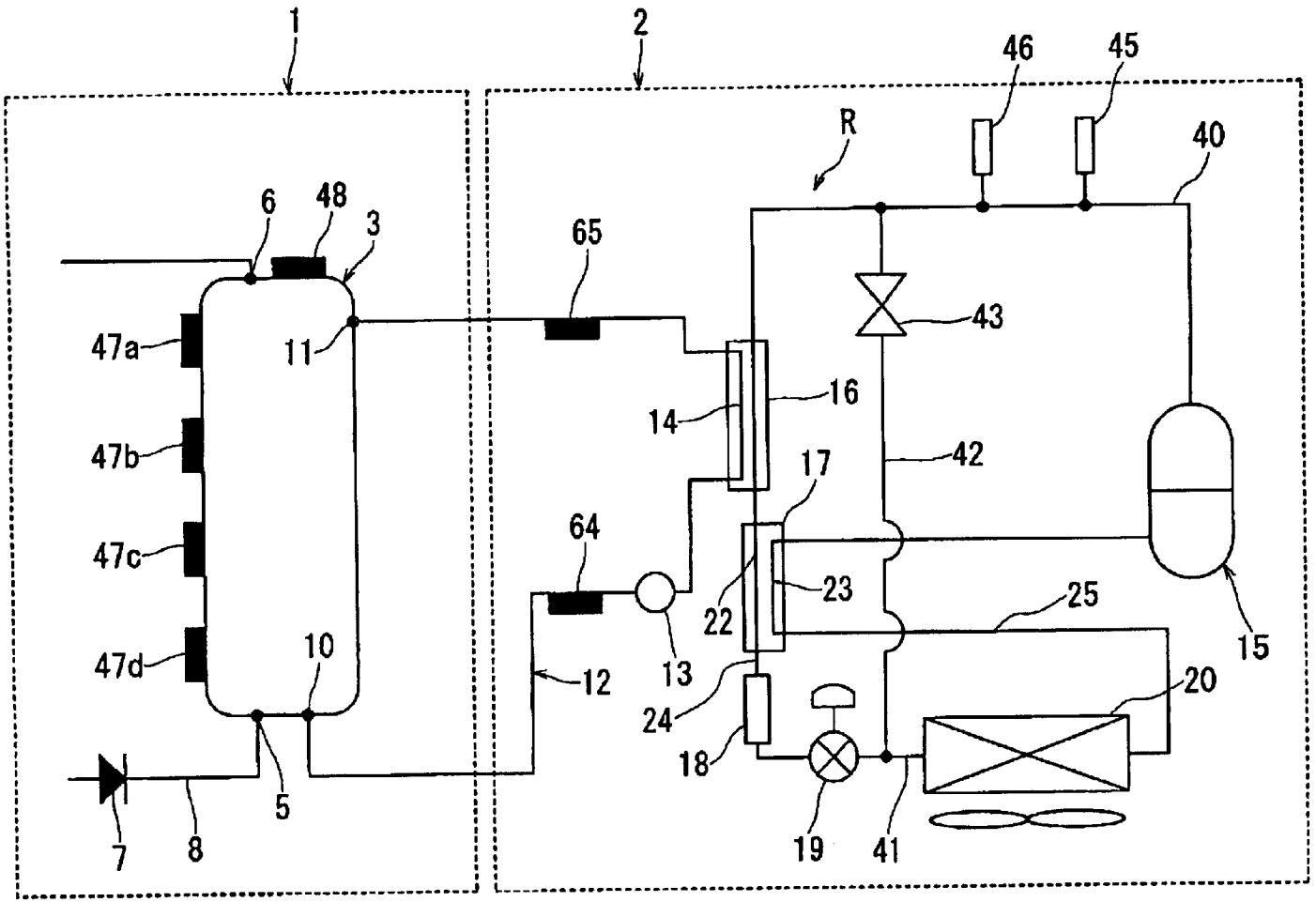
FIG. 1 is a simplified diagram showing a first embodiment of the refrigerant circuit of the present invention.

Hereinafter, concrete embodiments of the refrigerant circuit of the present invention will be described in detail with reference to the drawings. Referring to FIG. 1, there is shown in a simplified manner a hot water supply apparatus of the heat pump type making use of a refrigerant circuit of the present invention. The heat pump type hot water supply apparatus is made up of a tank unit 1 and a heat source unit 2. Water (hot water) held in the tank unit 1 is heated in the heat source unit 2.

The tank unit 1 is provided with a hot water storage tank 3, and hot water stored in the hot water storage tank 3 is supplied to a bath tub (not shown) or the like. To this end, the hot water storage tank 3 has, at its bottom wall, a water supply port 5. Provided in the upper wall of the hot water storage tank 3 is a hot water discharge port 6. More specifically, a supply of water is delivered to the hot water storage tank 3 from the water supply port 5, and high temperature hot water is delivered from the hot water discharge port 6. In this case, a water supply flow path 8 provided with a check valve 7 is connected to the water supply port 5, and a water intake port 10 is opened at the bottom wall of the hot water storage tank 3, and a hot water supply port 11 is opened at an upper portion of the side wall (circumferential wall) of the hot water storage tank 3. And, the water intake port 10 and the water supply port 11 are linked together by a circulation path 12, and a water circulation pump 13 and a heat exchange path 14 are inserted in the circulation path 12.

The hot water storage tank 3 is provided with four detectors 47*a*, 47*b*, 47*c*, 47*d* for detecting the remaining amount of hot water (hereinafter called the "hot water remaining amount detectors") which are vertically disposed at given pitches. Further, a temperature sensor 48 is mounted on the upper wall of the hot water storage tank 3. The hot water remaining amount detectors 47*a*, 47*b*, 47*c*, 47*d* and the temperature sensor 48 are implemented by thermistors. Additionally, in the circulation path 12, a water intake thermistor 64 is disposed on the upstream side of the heat exchange path 14 (more specifically, on the upstream side of the pump 13), and a hot water discharge thermistor 65 is disposed on the downstream side of the heat exchange path 14.

Furthermore, the heat source unit 2 is provided with a refrigerant circuit R formed in accordance with the present invention. The refrigerant circuit R is formed by sequential connection of a compressor 15, a water heat exchanger (condenser) 16 which constitutes the heat exchange path 14, a cooling section 17, a receiver 18, an expansion valve 19 which constitutes a pressure reducing mechanism, and an evaporator 20. And, as the refrigerant of the refrigerant circuit R, for example, carbon dioxide ($CO_2$) which is compressed to above a critical pressure is used. The refrigerant of the refrigerant circuit R is carbon dioxide used in so-called super-critical conditions. It should be noted that the condenser 16 is a device having a function of cooling a high temperature, high pressure super-critical refrigerant compressed in the compressor 15. The condenser 16 is called, in some cases, a gas cooling apparatus or a radiator.

Figure 2:
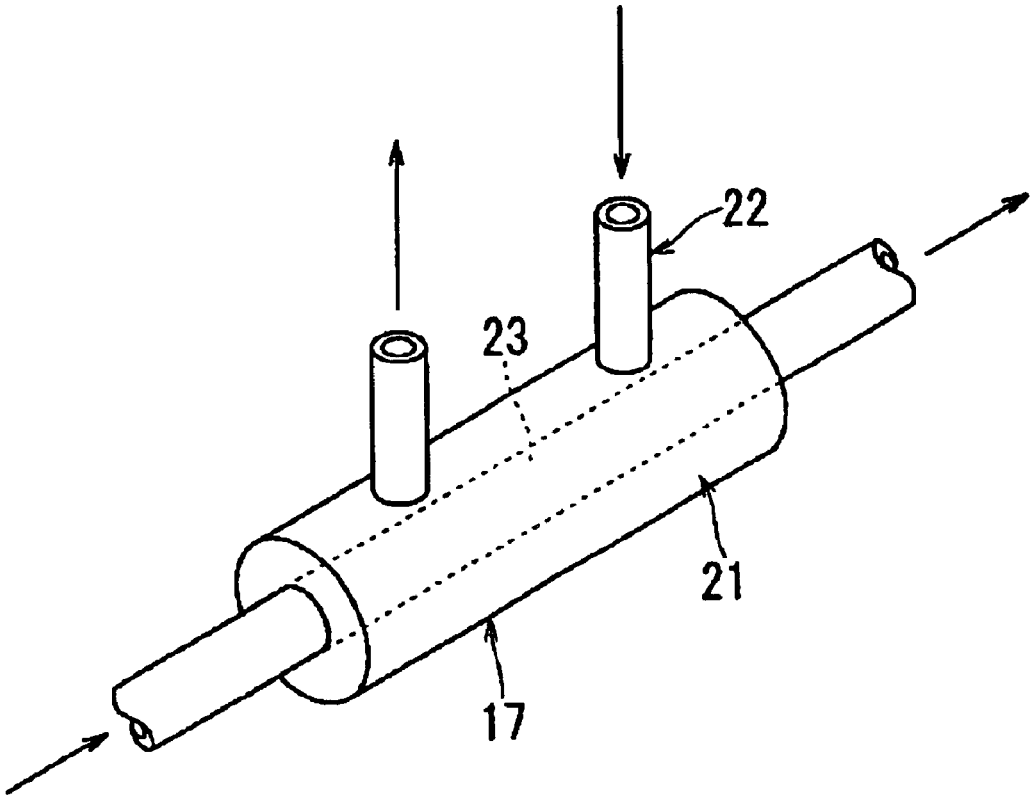
FIG. 2 is a perspective illustration of a cooling section of the refrigerant circuit.

The cooling section 17 cools refrigerant flowing out of the condenser 16, and is formed by a liquid gas heat exchanger 21 shown in FIG. 2. The liquid gas heat exchanger 21 has a double pipe structure, and is made up of a first passage way 22 through which refrigerant from the condenser 16 passes and a second passage way 23 through which refrigerant from the evaporator 20 passes. In other words, the first passage way 22 forms a part of a refrigerant flow path 24 by which the condenser 16 and the receiver 18 are connected together, while the second passage way 23 forms a part of a refrigerant flow path 25 by which the evaporator 20 and the compressor 15 are connected together. Accordingly, the cooling section 17 serves as a refrigerant-refrigerant heat exchanger, and heat is transferred between a high pressure, high temperature refrigerant passing through the first passage way 22 and a low pressure, low temperature refrigerant passing through the second passage way 23, whereby refrigerant flowing into the receiver 18 is cooled. Additionally, the low pressure refrigerant is heated, thereby making it possible to prevent the compressor 15 to performing a wet compression operation.

In the refrigerant circuit R, a refrigerant flow path 40 by which the compressor 15 and the water heat exchanger 16 are connected together and a refrigerant flow path 41 by which the expansion valve 19 and the evaporator 20 are connected together are linked together by a bypass circuit 42, and a defrost valve 43 is disposed in the bypass circuit 42. The refrigerant flow path 40 is provided with an HPS 45 as a pressure protection switch and a pressure sensor 46. The bypass circuit 42 is to supply a hot gas discharged from the compressor 15 to the evaporator 20, whereby defrost operations to defrost the evaporator 20 are performed. To this end, the heat source unit 2 is provided with a defrost control means (not shown) for establishing switching between the normal water heating operation and the defrost operation. Stated another way, during the normal water heating operation, the water heat exchanger 16 functions as a condenser for heating hot water passing through the heat exchange path 14. On the other hand, during the defrost operation, the expansion valve 19 is placed in the fully closed state while the defrost valve 43 is placed in the open state for allowing hot gas to flow into the evaporator 20. The evaporator 20 is heated by the hot gas, thereby preventing the generation of frost in the evaporator 20. The defrost control means is implemented, for example by the use of a microcomputer.

Next, the operational action (water heating operation) of the refrigerant circuit R will be described.

When the compressor 15 is activated while the water circulation pump 13 is activated or brought in operation, stored water (hot water) starts flowing out of the water intake port 10 provided at the bottom of the hot water storage tank 3 and flows in the heat exchange path 14 of the circulation path 12. At this time, the hot water is heated (boiled) by the water heat exchanger which is the condenser 16. Thereafter, the hot water is returned to the upper part of the hot water storage tank 3 from the water supply port 11. This operation is carried out continuously, whereby hot water is stored in the hot water storage tank 3. In the current electricity rate, the nighttime electricity unit cost is lower than the daytime electricity unit cost. Therefore, preferably the operation is carried out in late night hours during which the electricity unit cost is low, for the purpose of reducing costs.

Figure 26:
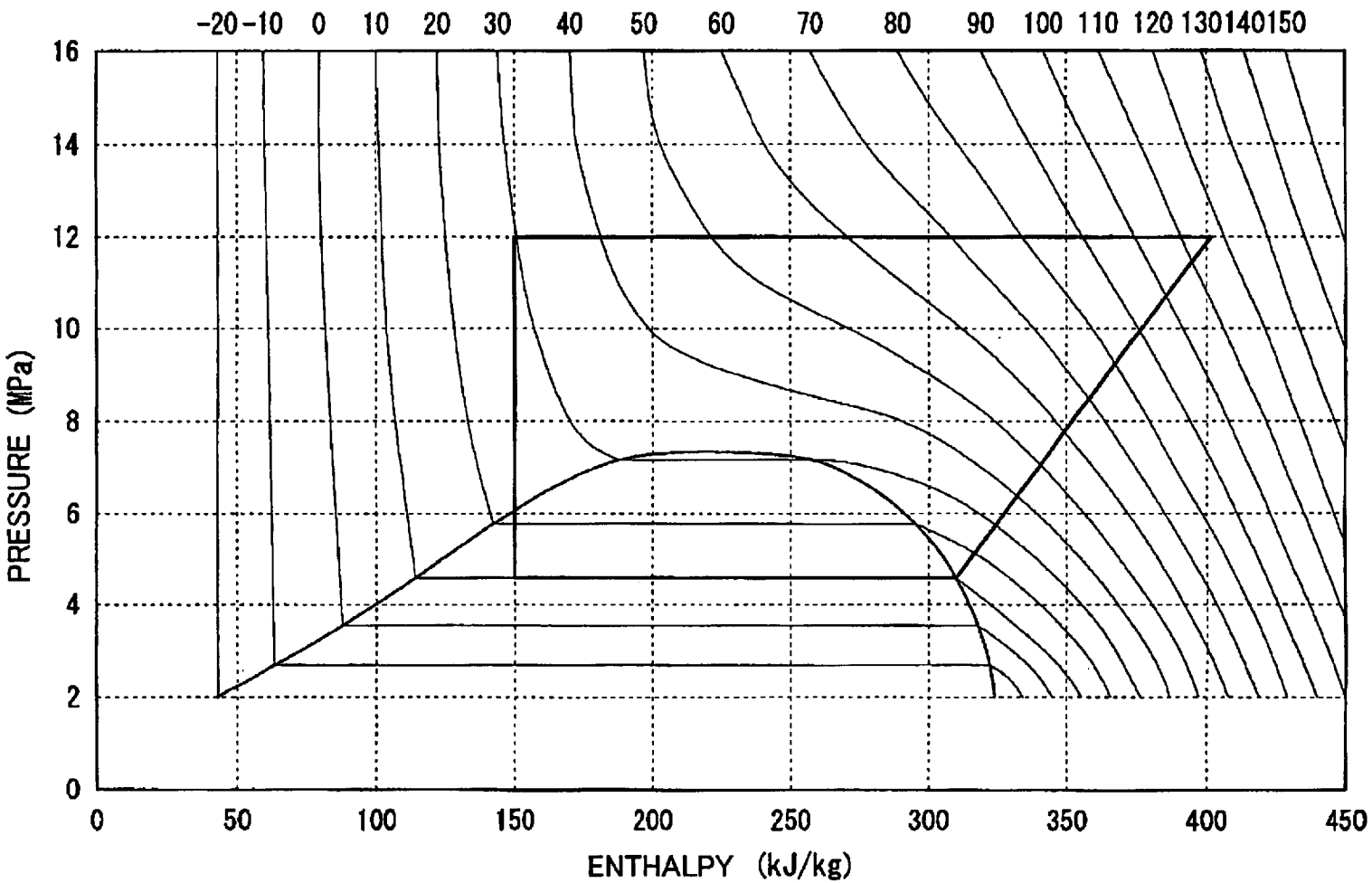
FIG. 26 graphically represents a refrigerating cycle of a conventional refrigerant circuit.
Figure 27:
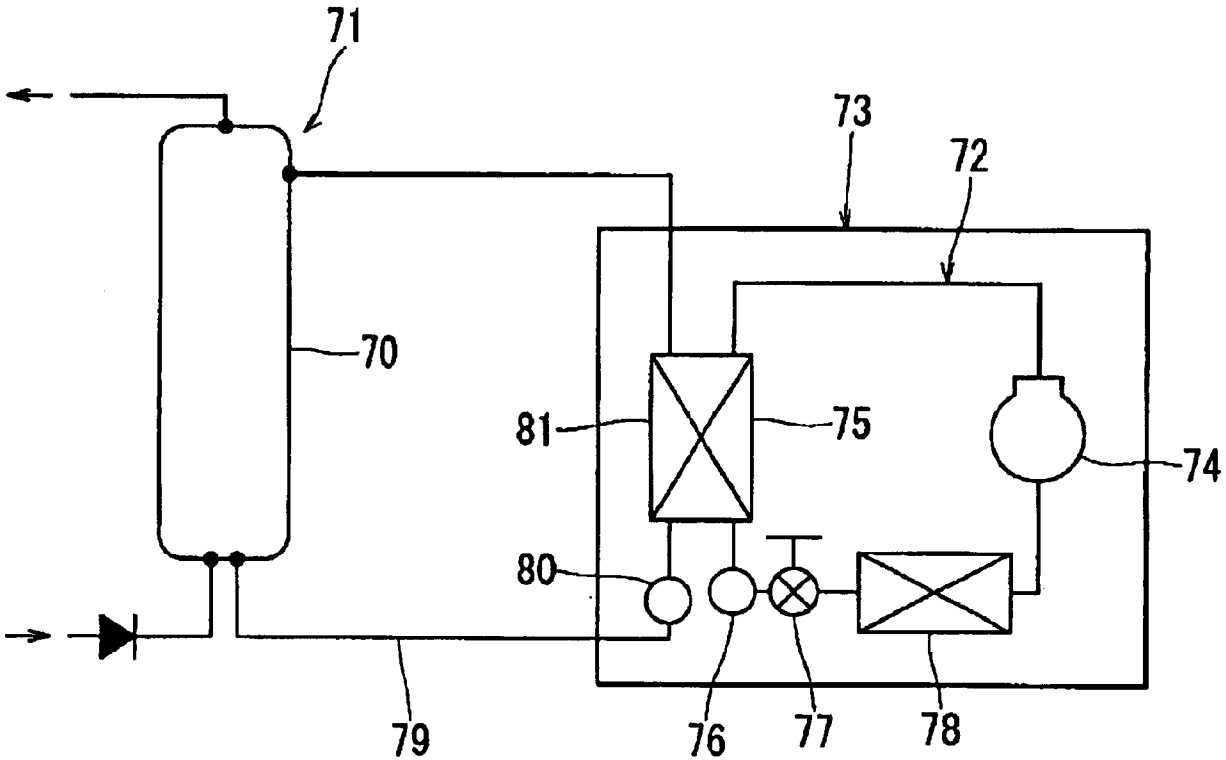
FIG. 27 is a simplified diagram of a conventional refrigerant circuit.
Figure 28:
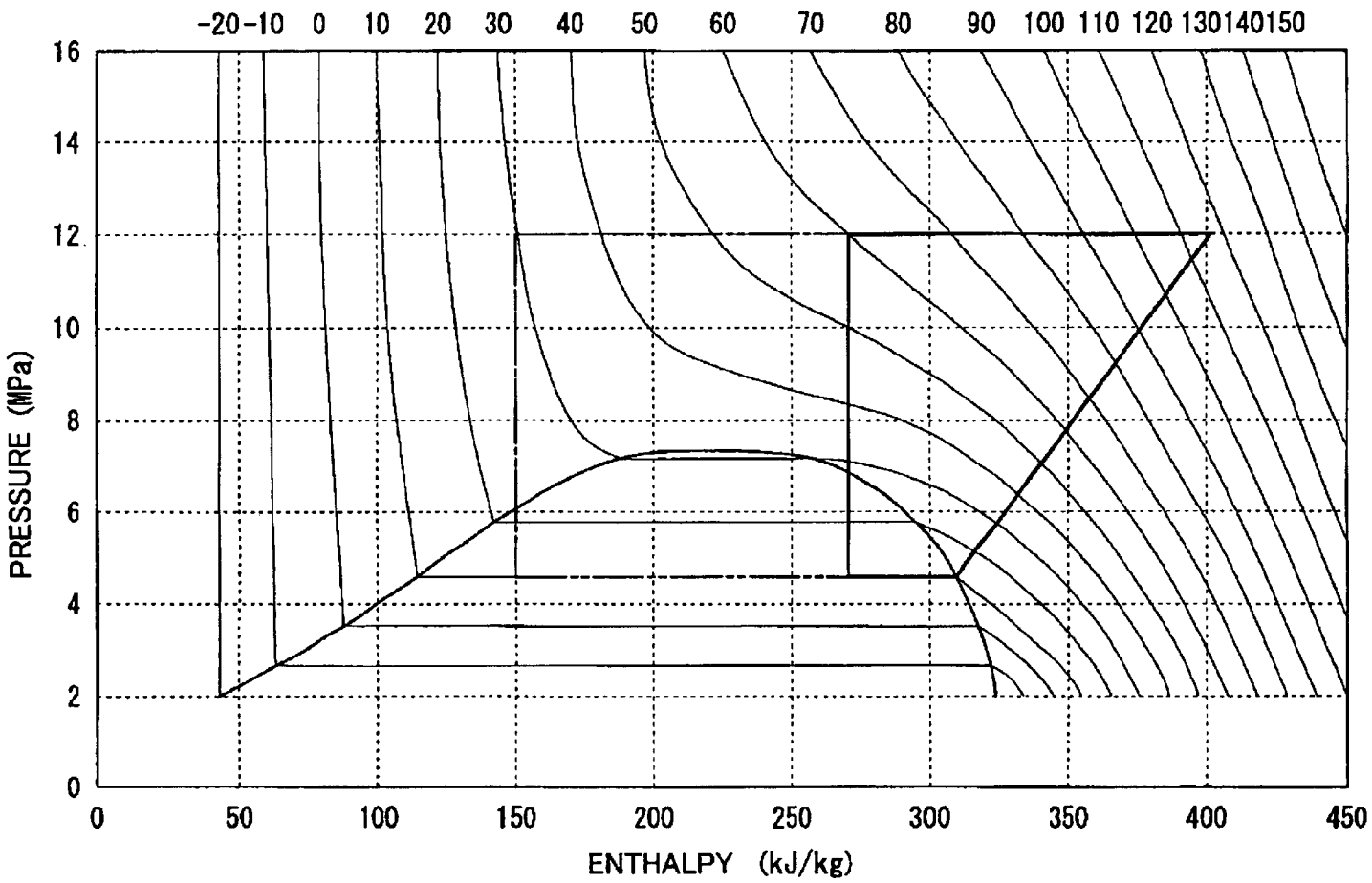
FIG. 28 graphically represents a refrigerating cycle for the purpose of describing drawbacks of a conventional refrigerant circuit.
Figure 29:
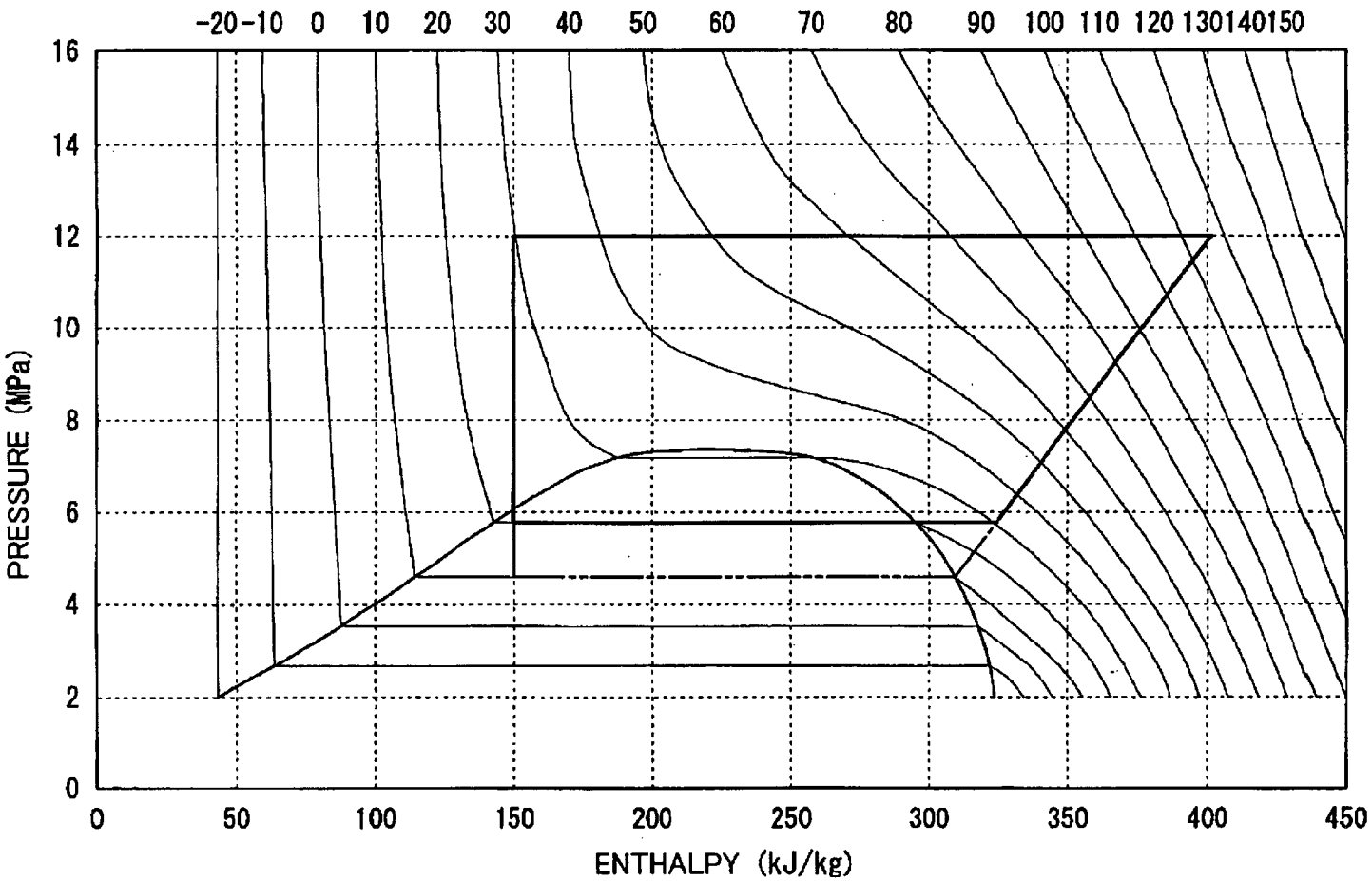
FIG. 29 graphically represents a refrigerating cycle for the purpose of describing drawbacks of a conventional refrigerant circuit.

When warm water is being boiled, high temperature hot water flows out into the circulation path 12 from the water intake port 10 if high temperature warm water is stored to the bottom of the hot water storage tank, with the result that the temperature of water entering into the water heat exchanger 75 rises. In a conventional refrigerant circuit, if the temperature of water entering into the water heat exchanger 16 rises, the refrigerating cycle shown in FIG. 26 becomes a refrigerating cycle as indicated by solid line of FIG. 28. Because of this, circulating refrigerant enters the excessive state (excess refrigerant state).

Figure 3:
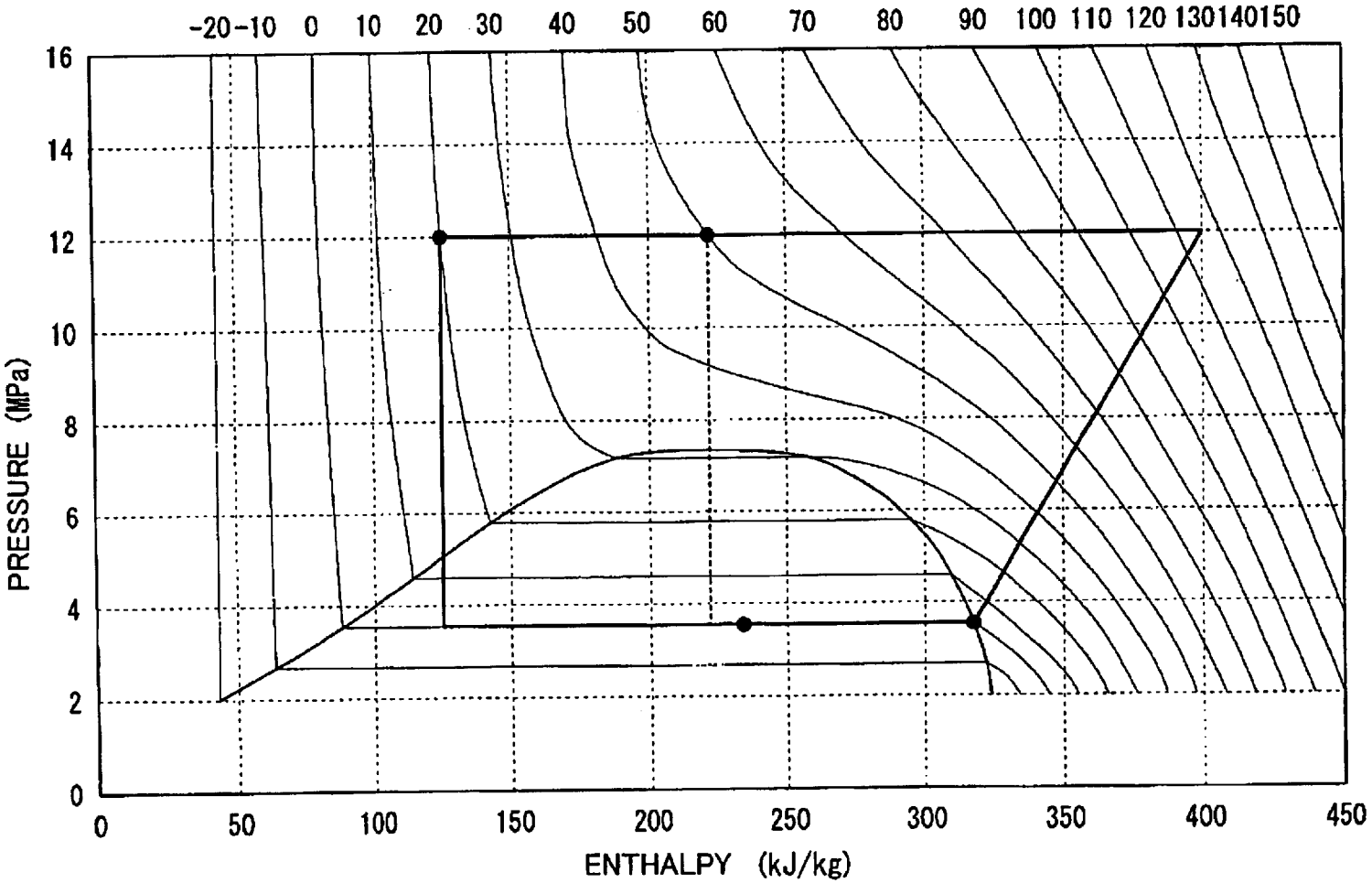
FIG. 3 graphically represents a refrigerating cycle of the refrigerant circuit.

However, since the refrigerant circuit R shown in FIG. 1 is provided with the cooling section 17, refrigerant is cooled sufficiently, and, on the high pressure side in front of the expansion valve 19, high density refrigerant is accumulated in the inside of the receiver 18. In other words, excess refrigerant processing is carried out, thereby making the amount of refrigerant circulating in the refrigerant circuit R adequate, and the refrigerant cycle as shown in FIG. 3 results. This makes it possible to perform stable operations, and the drop in COP does not take place. Besides, the capacity of a receiver to be disposed can be set low, and the entire refrigerant circuit can be downsized and the cost of production can be reduced. It is possible to carry out stable operations.

Figure 4:
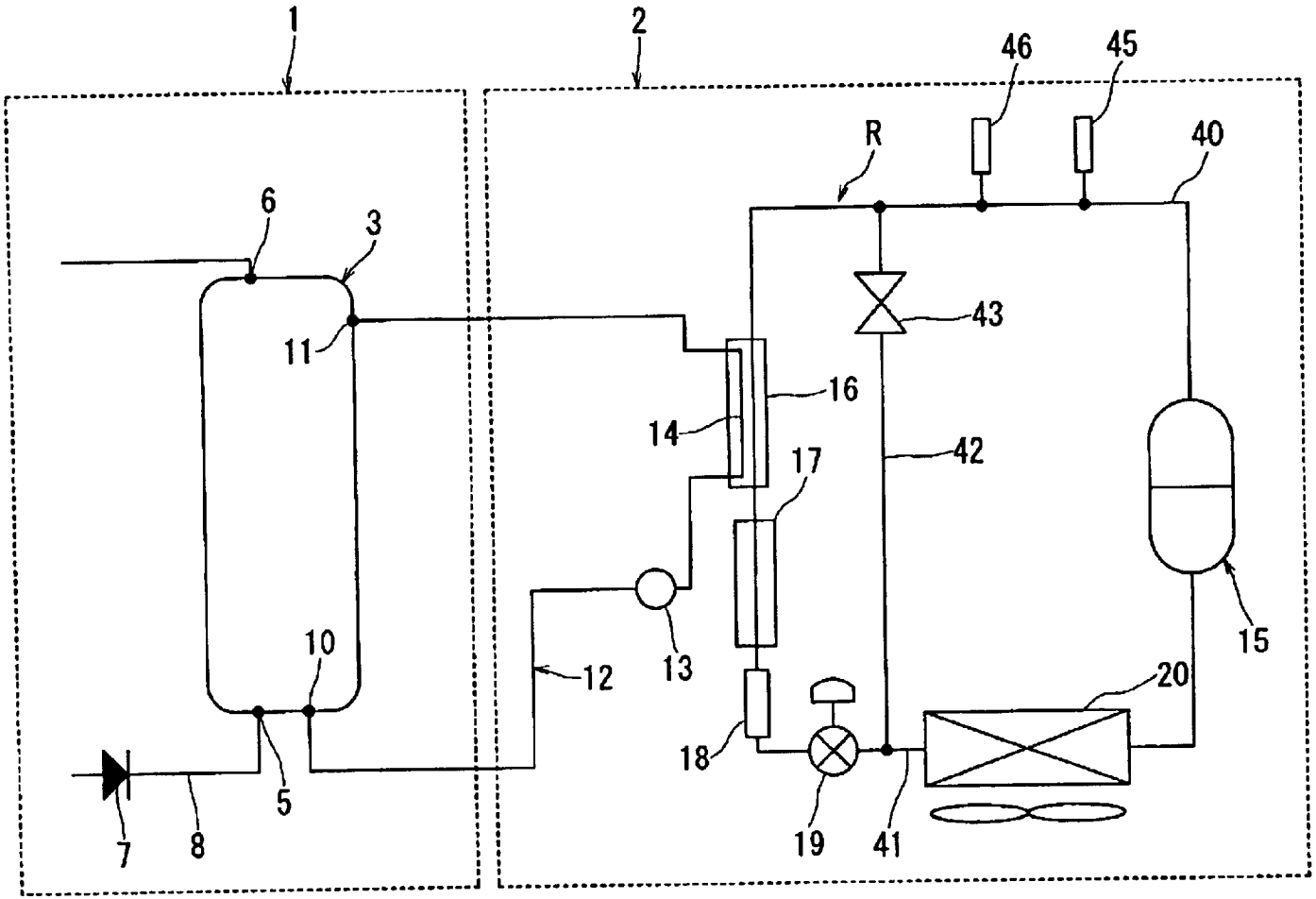
FIG. 4 is a simplified diagram showing the refrigerant circuit employing another cooling section.

Referring next to FIG. 4, there is shown a refrigerant circuit R in which the cooling section 17 is formed by an air heat exchanger 26. The cooling section 17 has a flow path constituting a part of the refrigerant flow path 24 by which the condenser 16 and the receiver 18 are connected together, and, when refrigerant passes through the flow path, it exchanges heat with air. Because of this, the amount of refrigerant which is accumulated in the inside of the receiver 18 is controlled also by the cooling section 17, thereby making the amount of refrigerant which circulates through the refrigerant circuit R adequate. It becomes possible to carry out stable operations.

Figure 5:
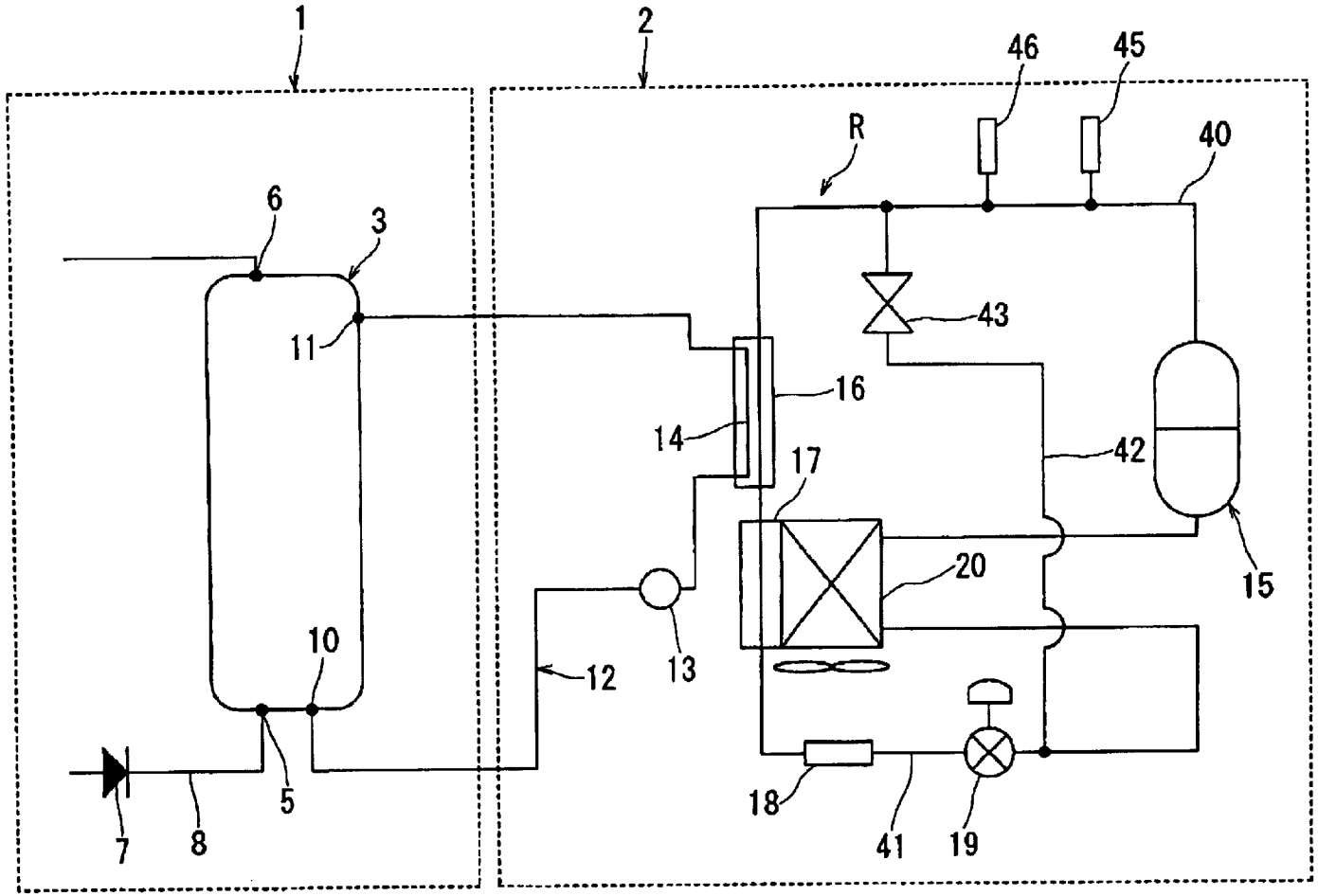
FIG. 5 is a simplified diagram showing the refrigerant circuit employing still another cooling section.

Referring to FIG. 5, there is shown a refrigerant circuit R in which a part of the evaporator 20 functions as an air heat exchanger serving as the cooling section 17. Stated another way, in this case the evaporator 20 is made up of a main body 27 having a great number of fins and first and second tubes 28 and 29 disposed in the inside of the main body 27. And, refrigerant from the expansion valve 19 passes through the first tube 28, and refrigerant from the condenser 16 passes through the second tube 29. That is, the original evaporation function is achieved by the main body 27, the first tube 28 et cetera, while the main body 27, the second tube 29 et cetera together function as the cooling section (air heat exchanger) 17 for cooling refrigerant flowing out of the condenser 16.

Figure 6:
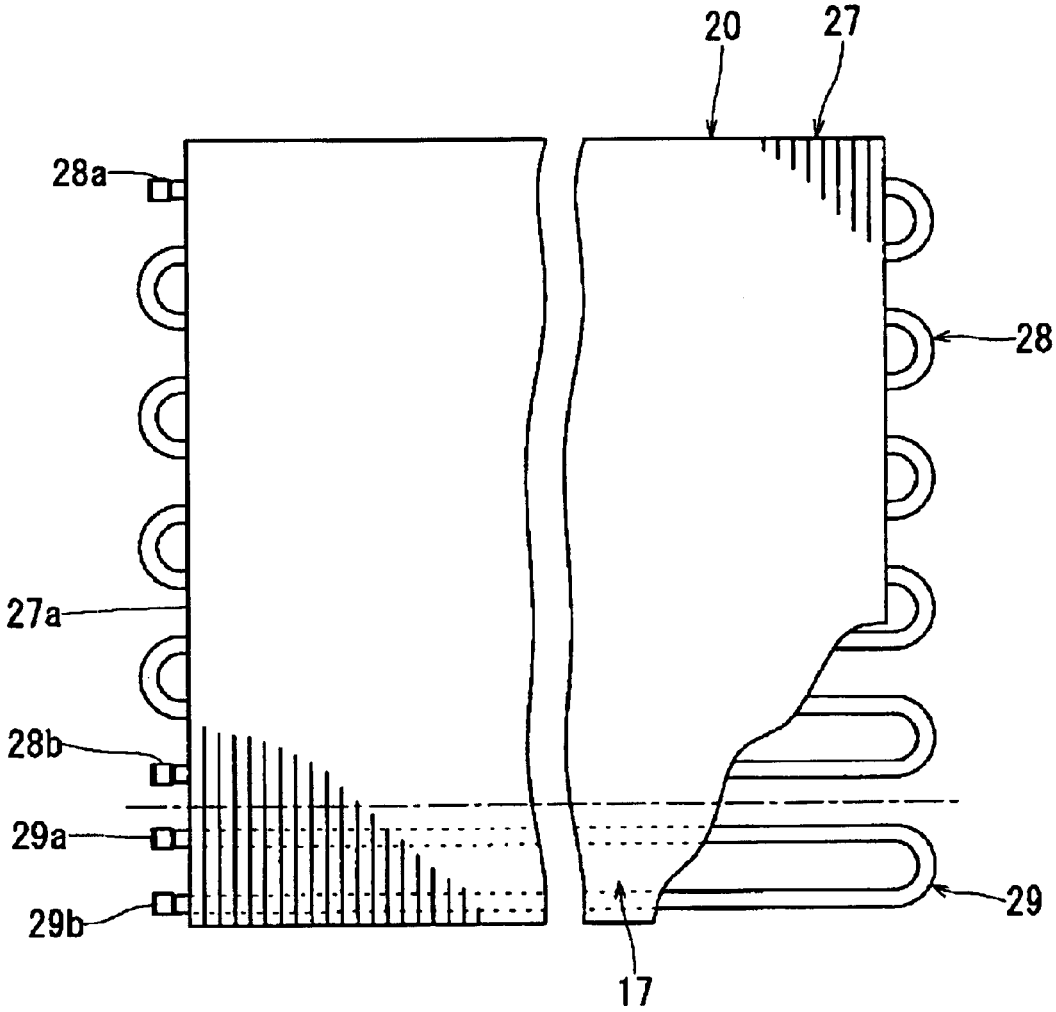
FIG. 6 is a front view of the cooling section.

In this case, the first tube 28 is formed into a snaking shape, and has openings 28*a* and 28*b* both of which are opened on the side of a side surface 27*a* of the main body 27. Additionally, the second tube 29 is formed into a U-shape, and has openings 29*a* and 29*b* both of which are opened on the side of the side surface 27*a* of the main body 27. Such an arrangement that a part of the evaporator 20 constitutes the cooling section 17 is not limited to the one as shown in FIG. 6. For example, the dimensions of the main body 27 and the length dimension of the first and second tubes 28 and 29 may be changed in a free manner.

Accordingly, the refrigerant circuit R of FIG. 5 is able to deal with excess refrigerant caused by the environmental variation such as the rise in water entrance temperature (the temperature of water entering into the water heat exchanger 16), as in the refrigerant circuit of FIG. 1. This makes the amount of refrigerant which circulates through the refrigerant circuit R adequate, thereby making it possible to ensure stable operations. Besides, neither the heat exchanger 21 as shown in FIG. 1 nor the heat exchanger 26 as shown in FIG. 4 is required, and the cooling section 17 is formed by a part of the evaporator 20 naturally necessary for such a type of refrigerant circuit, thereby making it possible to both downsize the entire refrigerant circuit R and reduce the cost of production.

Figure 7:
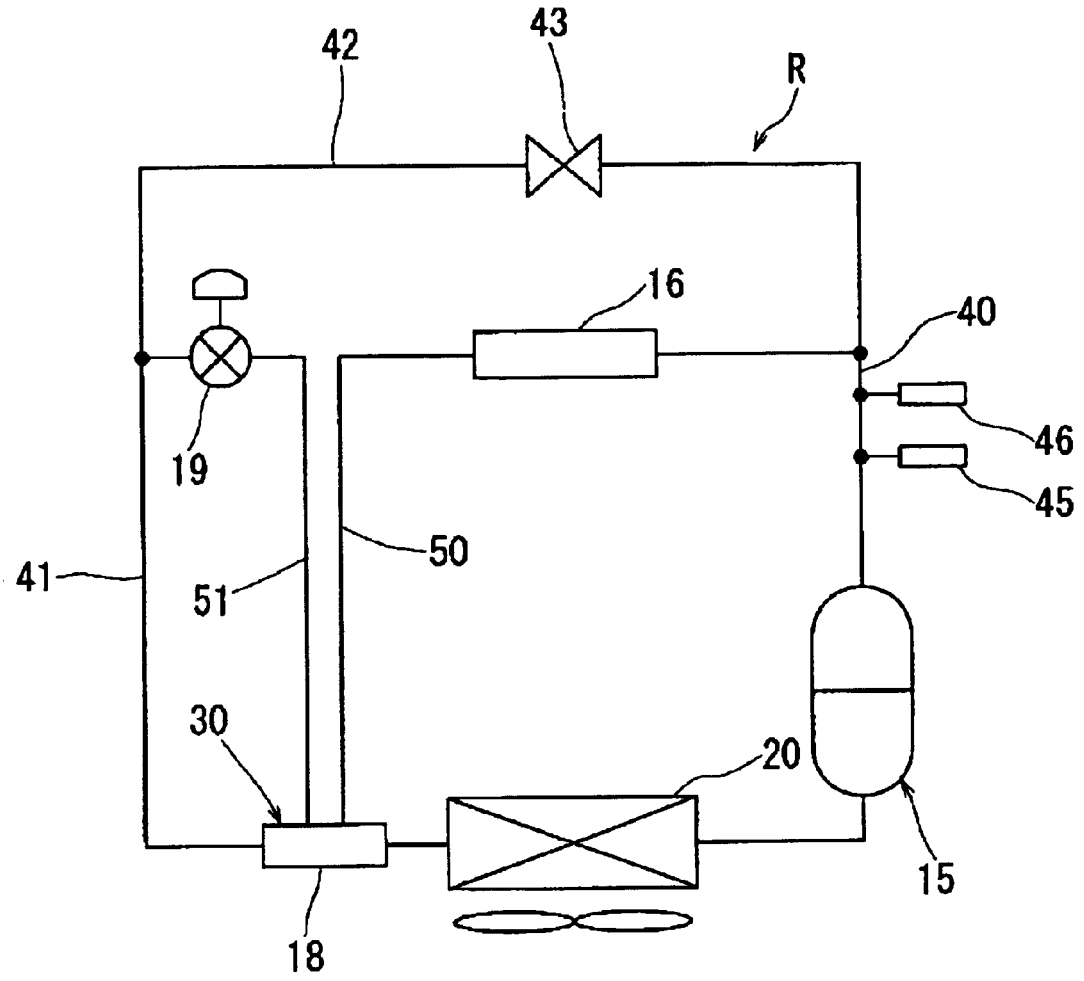
FIG. 7 is a simplified diagram showing a second embodiment of the refrigerant circuit of the present invention.
Figure 15:
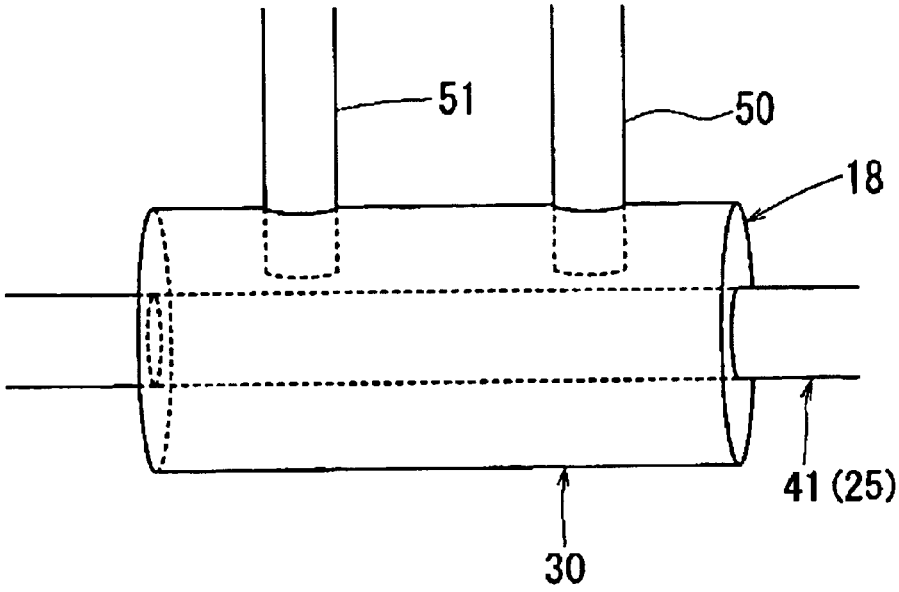
FIG. 15 is a simplified diagram showing a receiver applicable to each of the refrigerant circuits of FIGS. 7–14.

Referring next to FIG. 7, there is shown a refrigerant circuit R in which the receiver 18 shown in FIG. 15 is used for transferring heat between a high pressure refrigerant in the inside of the receiver 18 and a low pressure refrigerant. In other words, an inflow pipe 50 into which refrigerant from the condenser 16 flows, and an outflow pipe 51 by way of which refrigerant from the receiver 16 flows into the expansion valve 19 are connected to the receiver 18, and the refrigerant flow path 41 connecting together the expansion valve 19 and the evaporator 20 is penetrated through the receiver 18. Hereby, a heat exchange means 30 capable of transferring heat between a high pressure refrigerant flowing into the receiver 18 from the inflow pipe 50 and a low pressure refrigerant flowing in the refrigerant flow path 41, is constituted.

In accordance with the refrigerant circuit R of FIG. 7, it is ensured that heat is transferred without fail because refrigerant on the low pressure side for transferring heat is refrigerant on the inlet side of the evaporator 20, thereby making it possible to promote the accumulating of refrigerant in the inside of the receiver 18. Because of this, even under the condition that excess refrigerant is generated, the amount of refrigerant circulating through the refrigerant circuit R is held adequate, thereby preventing the occurrence of a wet operation and the drop in COP.

Figure 8:
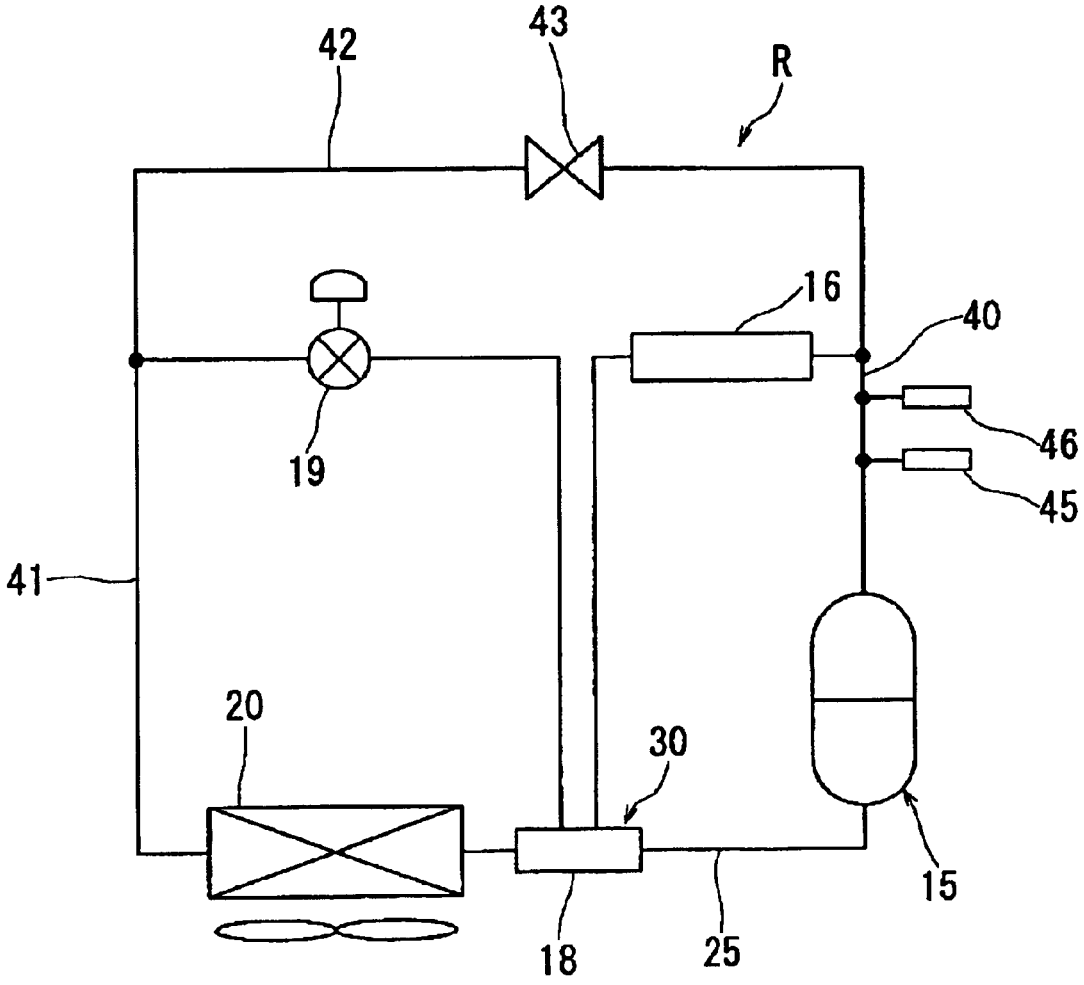
FIG. 8 is a simplified diagram showing a modification example of the refrigerant circuit.

Referring to FIG. 8, there is shown a refrigerant circuit R in which the refrigerant flow path (suction flow path) 25, by which the evaporator 20 and the compressor 15 are connected together, is penetrated through the receiver 18. Hereby, the heat exchange means 30 capable of transferring heat between a high pressure refrigerant in the inside of the receiver 18 and a low pressure refrigerant flowing in the refrigerant flow path 25, is constituted, thereby making it possible to both promote the accumulating of refrigerant in the inside of the receiver 18 and avoid the excess refrigerant state.

Figure 9:
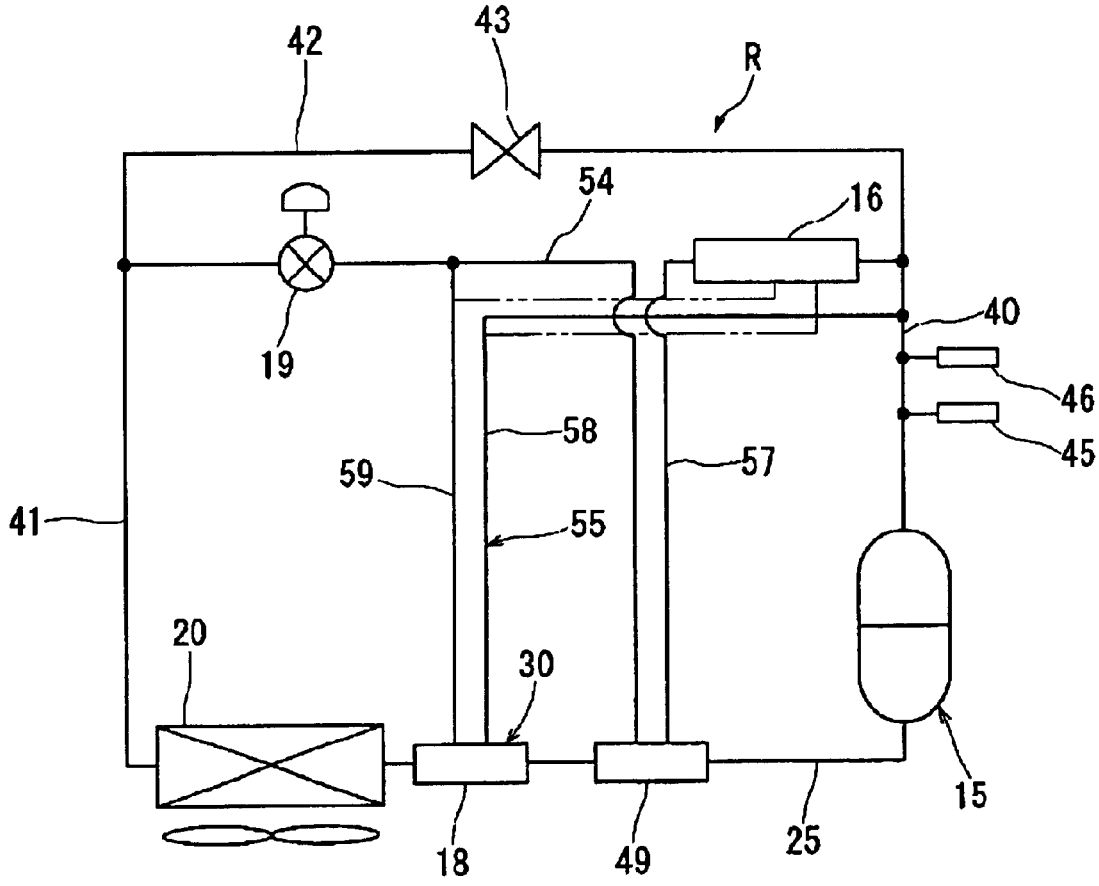
FIG. 9 is a simplified diagram showing a third embodiment of the refrigerant circuit of the present invention.

Referring next to FIG. 9, there is shown a refrigerant circuit R which comprises a main passage way 54 through which refrigerant from the compressor 15, after having passed through the condenser 16 and the heat exchanger 49, flows into the expansion valve 19, and a bypass circuit 55 by which a flow of refrigerant branches off from the main passage way 54 and merges with the main passage way 54 via the receiver 18. In other words, the main passage way 54 has a refrigerant flow path 40 (which is a refrigerant discharge path of the compressor 15) and a connecting pipe 57 extending from the condenser 16 and connected to the expansion valve 19 via the heat exchanger 49 (which is a heat exchanger for the supercooling of refrigerant flowing out of the condenser 16), while the bypass circuit 55 has a first pipe 58 which branches off from the refrigerant discharge path 40 and is connected to the receiver 18 and a second pipe 59 extending from the receiver 18 and connected to the main passage way 54. The heat exchanger 49 is operable to transfer heat between a refrigerant flowing in the connecting pipe 57 and a refrigerant flowing in the refrigerant flow path 25.

In accordance with the refrigerant circuit R of FIG. 9, in the main passage way 54, high pressure refrigerant from the compressor 15 flows in the following course: CONDENSER 16→HEAT EXCHANGER 49→EXPANSION VALVE 19→EVAPORATOR 20→RECEIVER 18→HEAT EXCHANGER 49→COMPRESSOR 15. Because of this, in the condenser 16 serving as a water heat exchanger, hot water circulating through the circulation path 12 (not shown) is heated. Additionally, in the bypass circuit 55, high pressure refrigerant from the compressor 15 flows into the receiver 18 and flows into the expansion valve 19 from the receiver 18. The refrigerant flows out of the evaporator 20, and is brought back to the compressor 15 by way of the refrigerant flow path 25. This constitutes the heat exchanging means 30 capable of transferring heat between a high pressure refrigerant which has flowed into the receiver 18 from the first pipe 58 and a low pressure refrigerant which is flowing in the refrigerant flow path 25.

Figure 10:
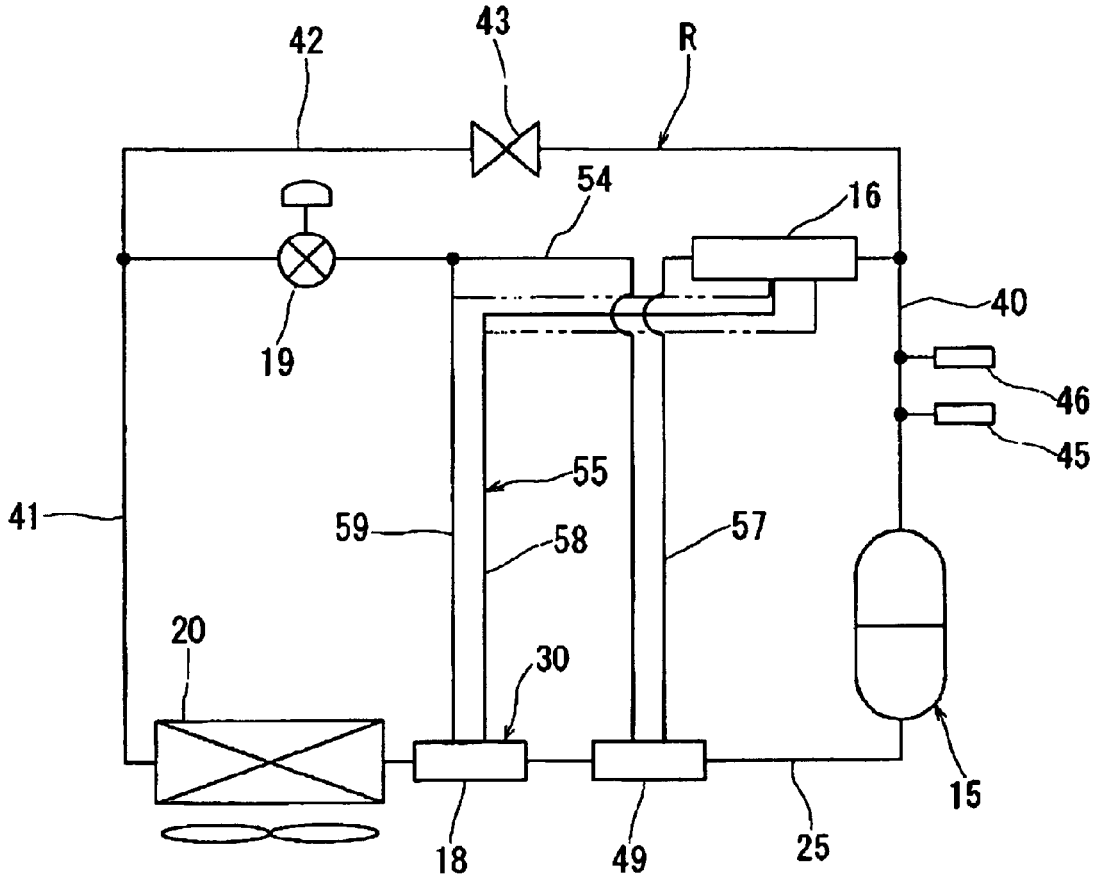
FIG. 10 is a simplified diagram showing a modification example of the refrigerant circuit.
Figure 11:
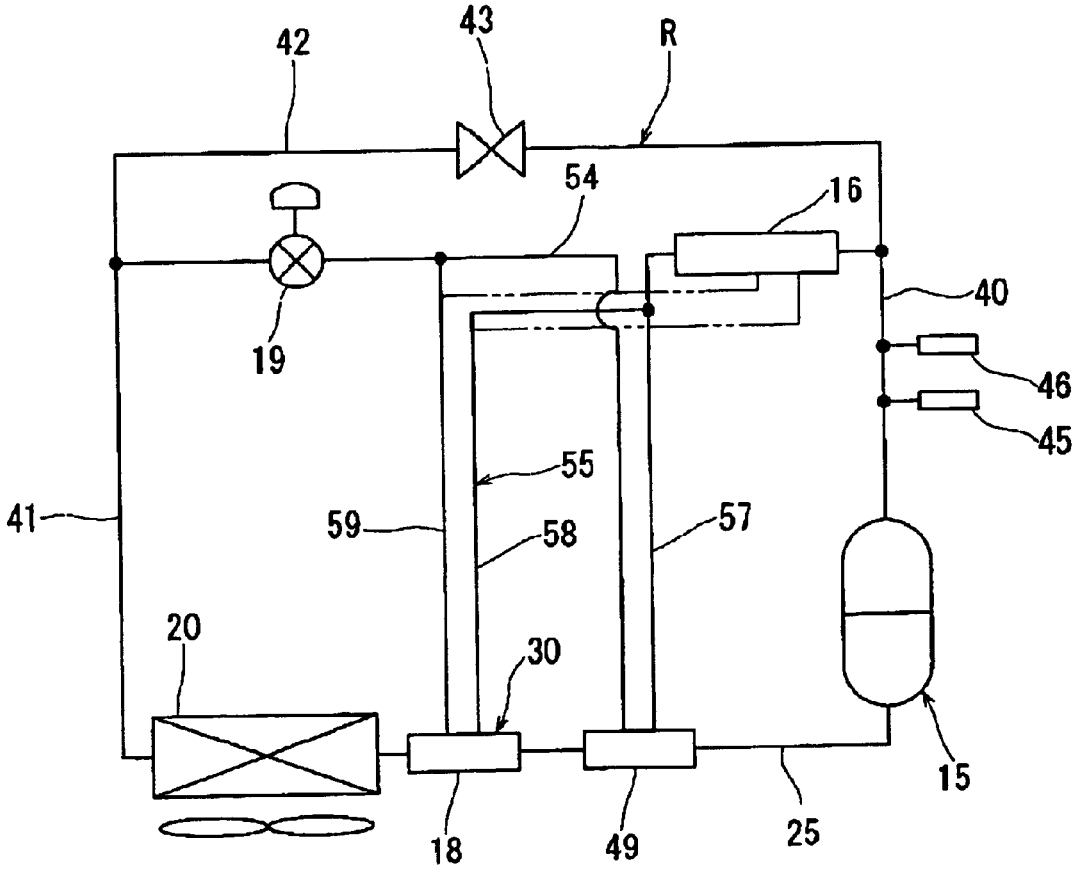
FIG. 11 is a simplified diagram showing another modification example of the refrigerant circuit.

FIG. 10 shows a refrigerant circuit R in which the condenser 16 and the receiver 18 are connected together by the first pipe 58, and FIG. 11 shows a refrigerant circuit R in which the outlet of the condenser 16 and the receiver 18 are connected together by the first pipe 58. Also in these refrigerant circuits R, heat is transferred between a high pressure refrigerant in the inside of the receiver 18 and a low pressure refrigerant flowing in the refrigerant flow path 25.

Figure 12:
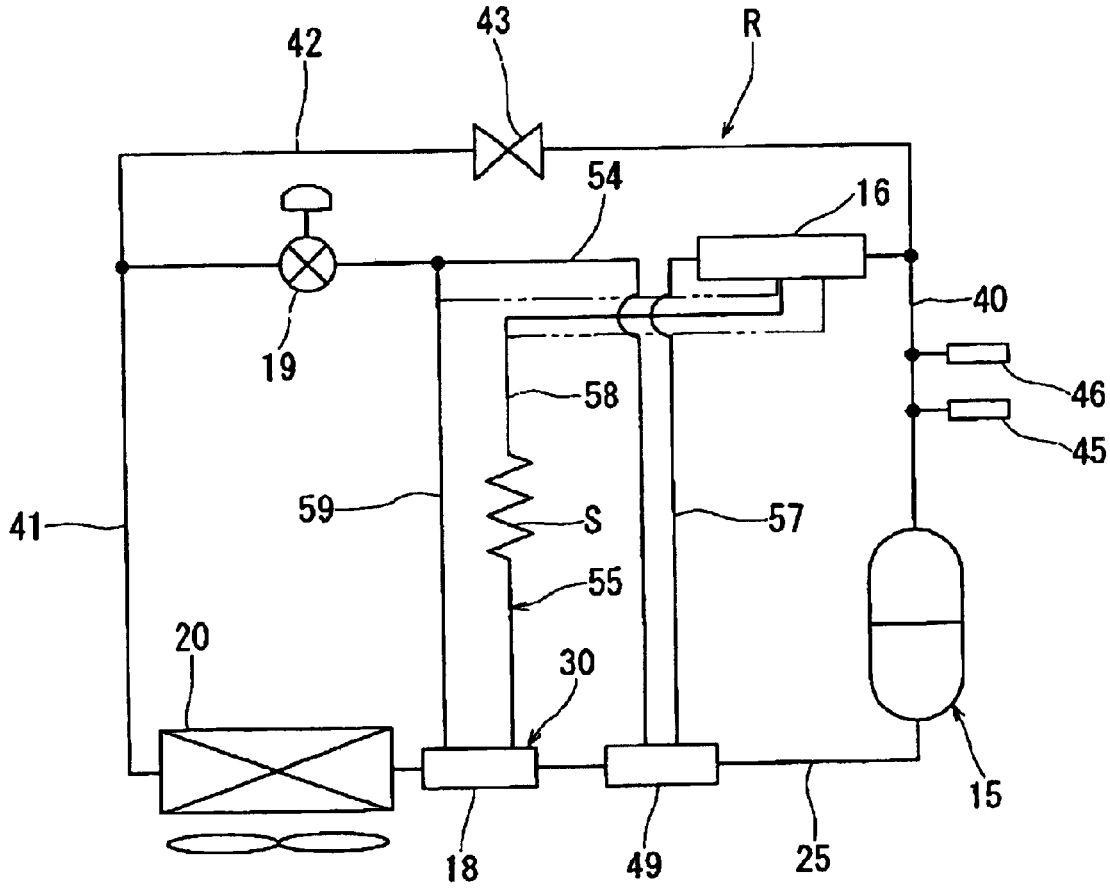
FIG. 12 is a simplified diagram showing a fourth embodiment of the refrigerant circuit of the present invention.
Figure 13:
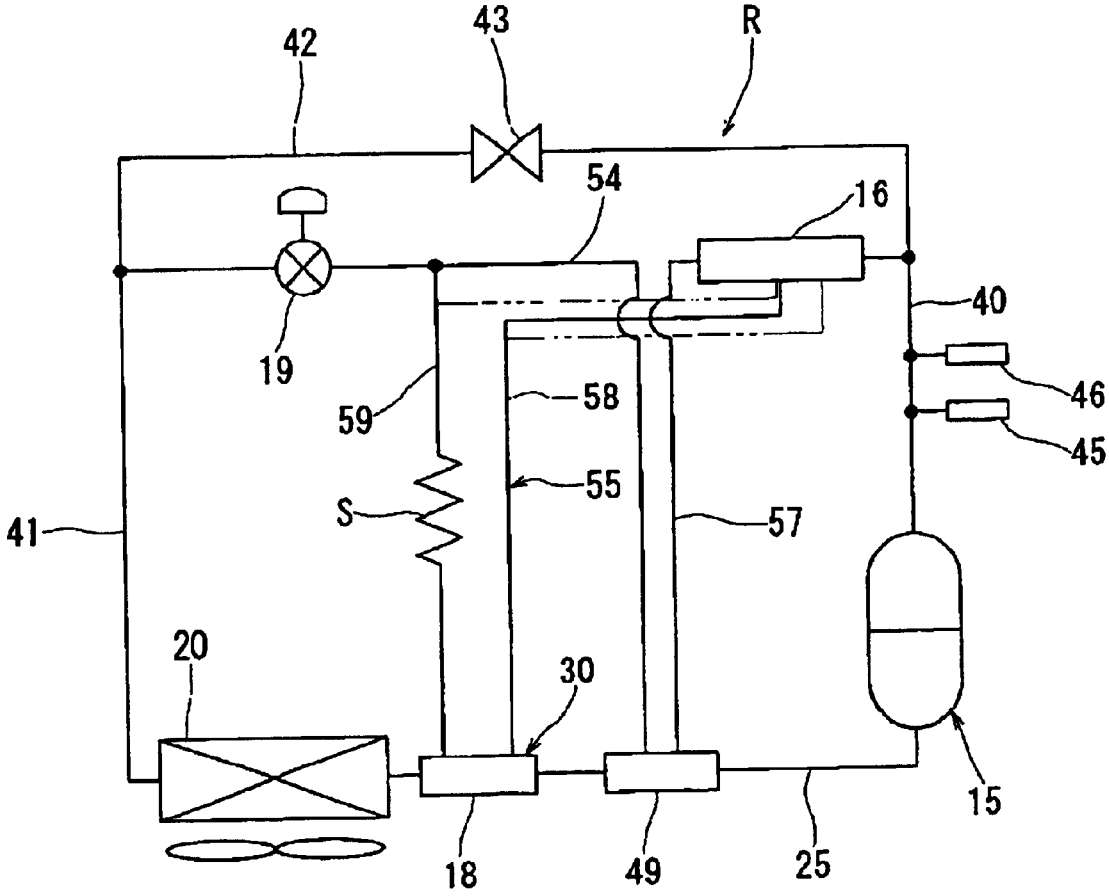
FIG. 13 is a simplified diagram showing a modification example of the refrigerant circuit.
Figure 14:
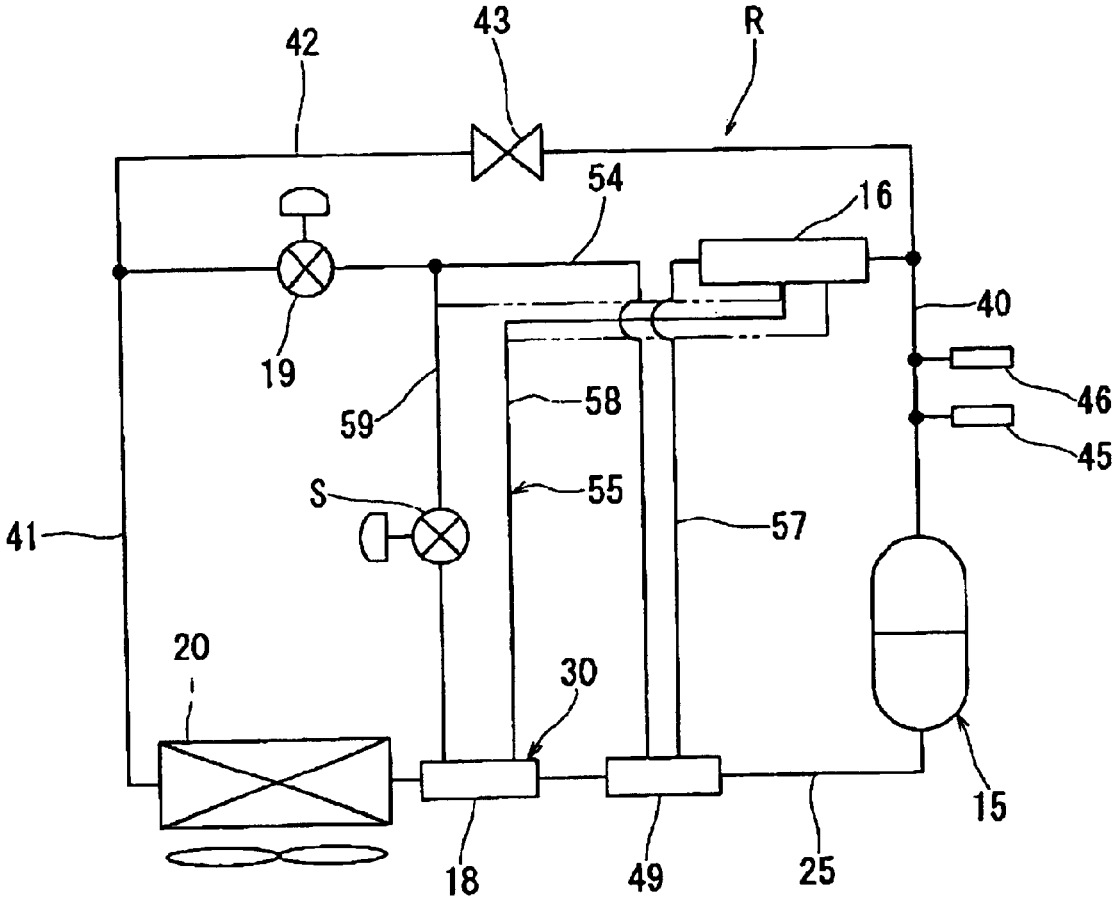
FIG. 14 is a simplified diagram showing another modification example of the refrigerant circuit.

FIG. 12 shows a refrigerant circuit R which is similar to the refrigerant circuit R of FIG. 10, with the exception that a throttling mechanism S (e.g., a capillary tube) is inserted in the first pipe 58. FIG. 13 shows a refrigerant circuit R which is similar to the refrigerant circuit R of FIG. 10, with the exception that a throttling mechanism S (e.g., a capillary tube) is inserted in the second pipe 59. In these cases, the flow rate of refrigerant passing through the receiver 18 can be varied. In other words, it is ensured that excess refrigerant generated by the difference in operational condition is accumulated in the inside of the receiver 18, thereby making it possible to achieve improvements in excess refrigerant absorption capacity. Furthermore, FIG. 14 shows a refrigerant circuit R which employs an electric valve in place of the throttling mechanism S and exhibits the same effects that the refrigerant circuit R shown in FIG. 13 does. Accordingly, the refrigerant circuit R shown in FIG. 12 may employ an electric valve in place of a capillary tube. Furthermore, in the refrigerant circuits R shown in FIGS. 9 and 11, the bypass circuit 55 may be provided with the throttling mechanism S.

In the refrigerant circuits R of FIGS. 7 and 8, the refrigerant state in the inside of the receiver 18 is determined by the outlet state of the water heat exchanger (condenser) 16. Therefore, the excess refrigerant absorption capacity of the receiver is: (the refrigerant density at the water heat exchanger's 16 outlet)×volume. Accordingly, in these refrigerant circuits, the absorption capacity is not very great. On the other hand, in the refrigerant circuits R of FIGS. 9, 10, 12 and 13, it is possible to accumulate a refrigerant the temperature of which is different from the outlet temperature of the water heat exchanger (condenser) 16, i.e., a refrigerant whose temperature is higher than the outlet temperature. Hereby, the refrigerant density difference for every operational area can be increased, therefore enhancing the excess refrigerant absorption capacity. In this case, the refrigerant circuit R shown in FIG. 9 exhibits the greatest excess refrigerant absorption capacity, the reason for which is that its refrigerant temperature variation range in the inside of the receiver 18 is greatest. Furthermore, comparison in heat loss (the amount of liberation of heat to other than water in the water heat exchanger) was made with respect to the refrigerant circuits R of FIGS. 9–11. The refrigerant circuit R shown in FIG. 9 is greatest in heat loss. The refrigerant circuit R shown in FIG. 10 is less in heat loss than the refrigerant circuit R shown in FIG. 9. The refrigerant circuit R shown in FIG. 11 is least in heat loss, the reason for which is that the first pipe 58 branches off from the outlet side of the condenser 16 in the refrigerant circuit R of FIG. 11.

Figure 16:
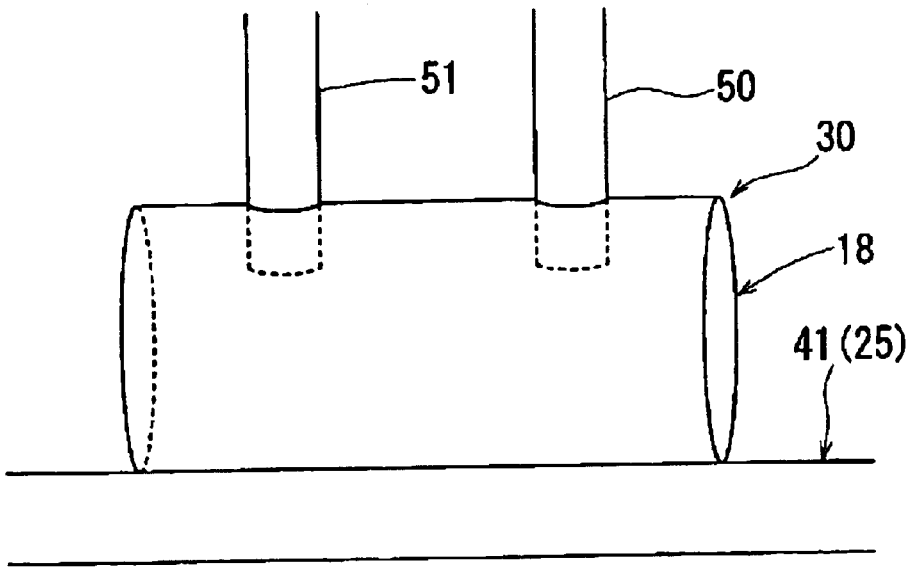
FIG. 16 is a simplified diagram showing another receiver.

It may be arranged such that the receiver 18 of each of the refrigerant circuits R shown in FIGS. 7–14 is implemented by the one shown in FIG. 16. When employing such arrangement, either the refrigerant flow path 41 or the refrigerant flow path 25 is made to extend along an external surface of the receiver 18, whereby heat is transferred between a high pressure refrigerant in the inside of the receiver 18 and a low pressure refrigerant flowing in the refrigerant flow path 41 (or the refrigerant flow path 25). In the case where the refrigerant flow path 41 (or the refrigerant flow path 25) is made to extend along the receiver 18, it may be either disposed linearly parallelly or wound around the outer peripheral surface of the receiver 18.

In each of the refrigerant circuits R shown in FIGS. 9–14, it may be arranged such that the first pipe 58 of the bypass circuit 55 is connected to an upstream portion of the water heat exchanger 16 while the second pipe 59 of the bypass circuit 55 is connected to an intermediate portion of the water heat exchanger 16, as indicated by virtual line. As a result of such connecting arrangement, it becomes possible to reduce heat loss and optimize the rise in inlet refrigerant temperature of the receiver 18. In this case, the main passage way 54 is a passage way as indicated by solid line (see FIGS. 9–14). As in the refrigerant circuits R of FIGS. 9–14 provided with the receiver 18 and the heat exchanger (liquid gas heat exchanger) 49, the order in which they are disposed may be in reverse with respect to the examples shown in the figures.

Figure 17:
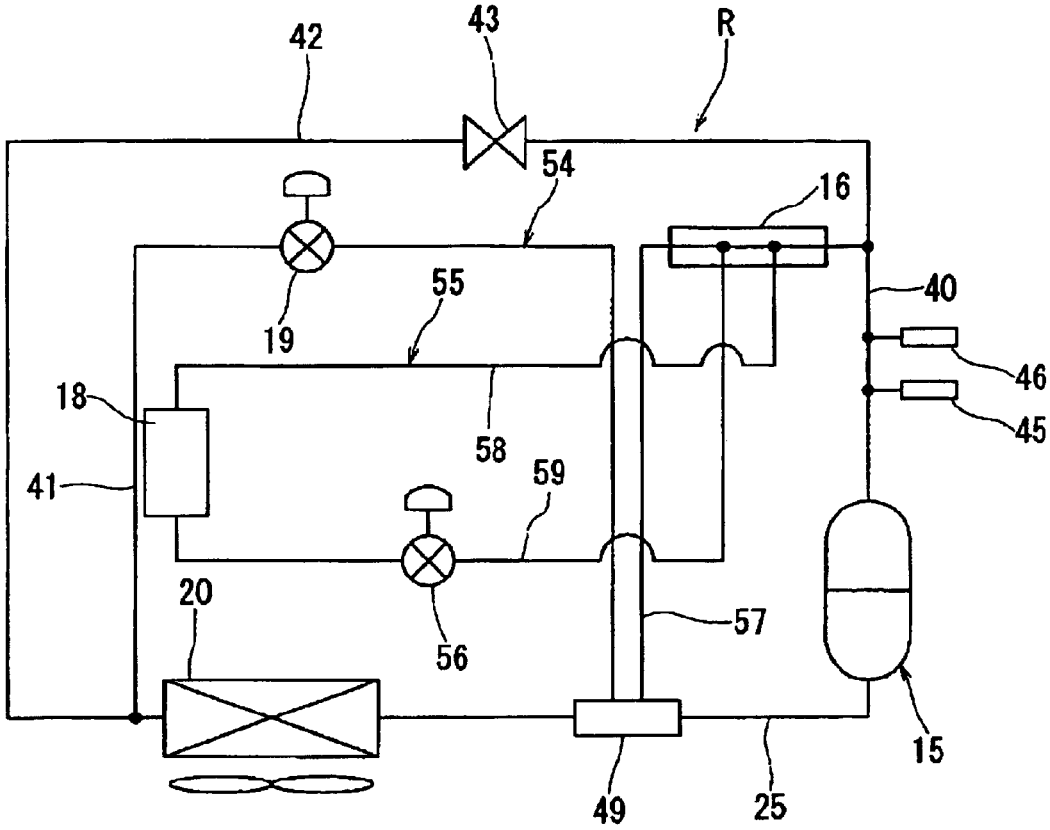
FIG. 17 is a simplified diagram showing a fifth embodiment of the refrigerant circuit of the present invention.

As shown in FIG. 17, it may be arranged such that the bypass circuit 55, which branches off from the condenser 16 and merges with the condenser 16 at a location downstream of the branch point and the receiver 18, is inserted in the bypass circuit 55 for transferring heat between a high pressure refrigerant in the inside of the receiver 18 and a low pressure refrigerant on the inlet side of the evaporator 20. Stated another way, the main passage way 54, by way of which high pressure refrigerant from the compressor 15, after having passed through the condenser 16, flows into the expansion valve 19, has the refrigerant discharge path 40 and the connecting pipe 57, and the bypass circuit 55 is connected to the main passage way 54.

More specifically, in the bypass circuit 55, the first pipe 58 is connected to a point slightly upstream of the intermediate part of the condenser 16 while the second pipe 59 is connected to a point slightly downstream of the intermediate part of the condenser 16. Interposed between the first pipe 58 and the second pipe 59 is the receiver 18. As a result of such arrangement, a flow of high pressure refrigerant branched off from the main passage way 54 passes through the receiver 18 and merges with the main passage way 54, in other words the high pressure refrigerant flows back to the main passage way 54.

Also in this case, refrigerant in the main passage way 54 flows in the connecting pipe 57 and, therefore, flows into the expansion valve 19 via the heat exchanger 49 which is a heat exchanger for the supercooling of refrigerant flowing out of the condenser 16.

Figure 18:
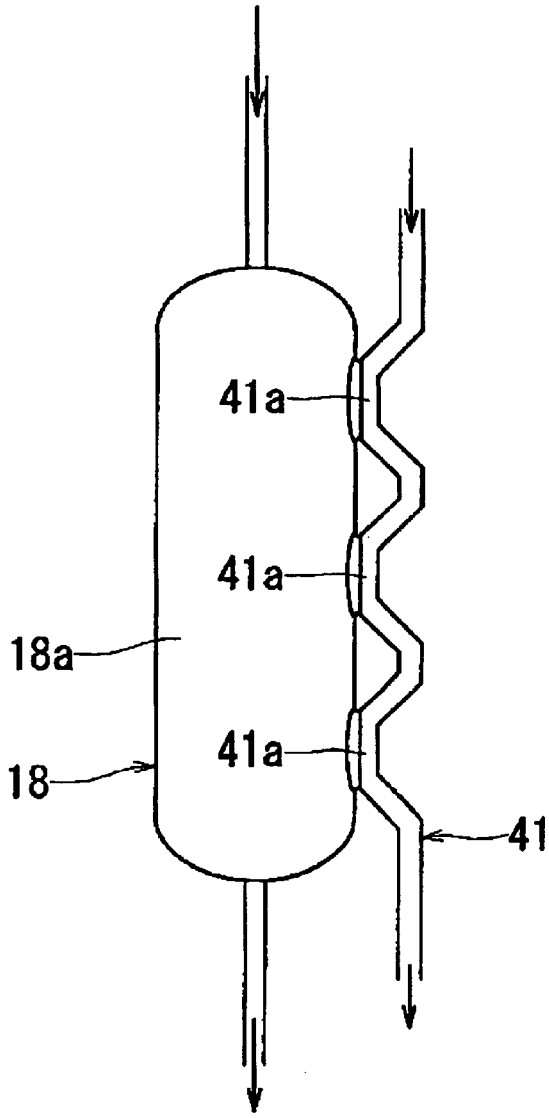
FIG. 18 is a simplified front view showing a receiver applied to the refrigerant circuit of FIG. 17.
Figure 19:
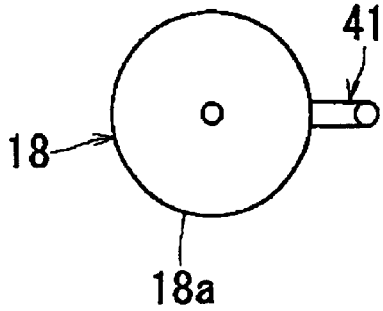
FIG. 19 is a simplified top plan view showing the receiver applied to the refrigerant circuit of FIG. 17.

And, as shown in FIGS. 18 and 19, the receiver 18 is heat exchangeably disposed in a side-by-side relationship with the refrigerant flow path 41 which is a low pressure pipe by which the expansion valve 19 and the evaporator 20 are connected together. In other words, a section of the refrigerant flow path 41 that extends along the receiver 18 is zigzag-shaped, and projecting portions 41*a*, . . . in proximity to or in contact with the receiver 18 are connected to an outer wall 18*a* of the receiver 18 by connecting means such as brazing. Hereby, heat is transferred between a high pressure refrigerant passing through the receiver 18 and a low pressure refrigerant flowing in the refrigerant flow path 41. At this time, the connection areas where the refrigerant flow path 41 and the receiver 18 are brought into contact with each other are scattered, thereby preventing local heat exchange, in other words total heat exchange is carried out.

Of course, it may be arranged such that the refrigerant flow path 41, which is not zigzag-shaped, extends along the outer wall 18*a* of the receiver 18 and a section of the refrigerant flow path 41 in proximity to or in contact with the receiver 18 is connected thereto by connecting means such as brazing.

Furthermore, as shown in FIG. 17, a flow rate control valve 56 implemented by an electric valve is inserted in the second pipe 59 by which the receiver 18 and the condenser 16 are connected together. In other words, the flow rate control valve 56 is provided on the outlet side of the receiver 18. When the flow rate control valve 56 is fully opened, the refrigerant temperature rises and the amount of refrigerant storage in the inside of the receiver 18 decreases. At the time of controlling the valve travel of the flow rate control valve 56, the refrigerant temperature is held at a level required and the amount of refrigerant storage in the inside of the receiver 18 is made adequate. When the flow rate control valve 56 is fully closed, the refrigerant temperature falls and the amount of refrigerant storage in the inside of the receiver 18 increases. This ensures that excess refrigerant generated by the difference in operational condition is dealt with stably without fail.

In the refrigerant circuit of FIG. 17, a defrost valve 43 is inserted in the defrost pipe line (bypass circuit) 42. In other words, the defrost pipe line 42 branching off from the refrigerant discharge path 40 is connected to the refrigerant flow path 41 on the inlet side of the evaporator 20. This prevents heat loss during the defrost operation.

As described above, also in the refrigerant circuit of FIG. 17, the accumulating of refrigerant in the inside of the receiver 18 is promoted, thereby avoiding the excess refrigerant state. In addition, also in the refrigerant circuit of FIG. 17, the change in position of the branch part and the merging part of the bypass circuit 55 can be made in a free manner as shown by solid and virtual lines of FIGS. 9–14. For example, it may be arranged such that the first pipe 58 of the bypass circuit 55 is connected to an upstream part of the condenser 16 while the second pipe 59 of the bypass circuit 55 is connected to a downstream part of the condenser 16. To sum up, it suffices if there is generated a difference in pressure level between the first pipe 58 and the second pipe 59 in front of the expansion valve 19.

The refrigerant circuit R includes, in some cases, an accumulator for preventing the occurrence of liquid back to the compressor 15. However, there are problems with the provision of such an accumulator. That is, the cost of production increases and the suction pressure loss of the compressor 15 increases, resulting in reductions in the COP, and there occurs abnormal noise in the accumulator.

Figure 20:
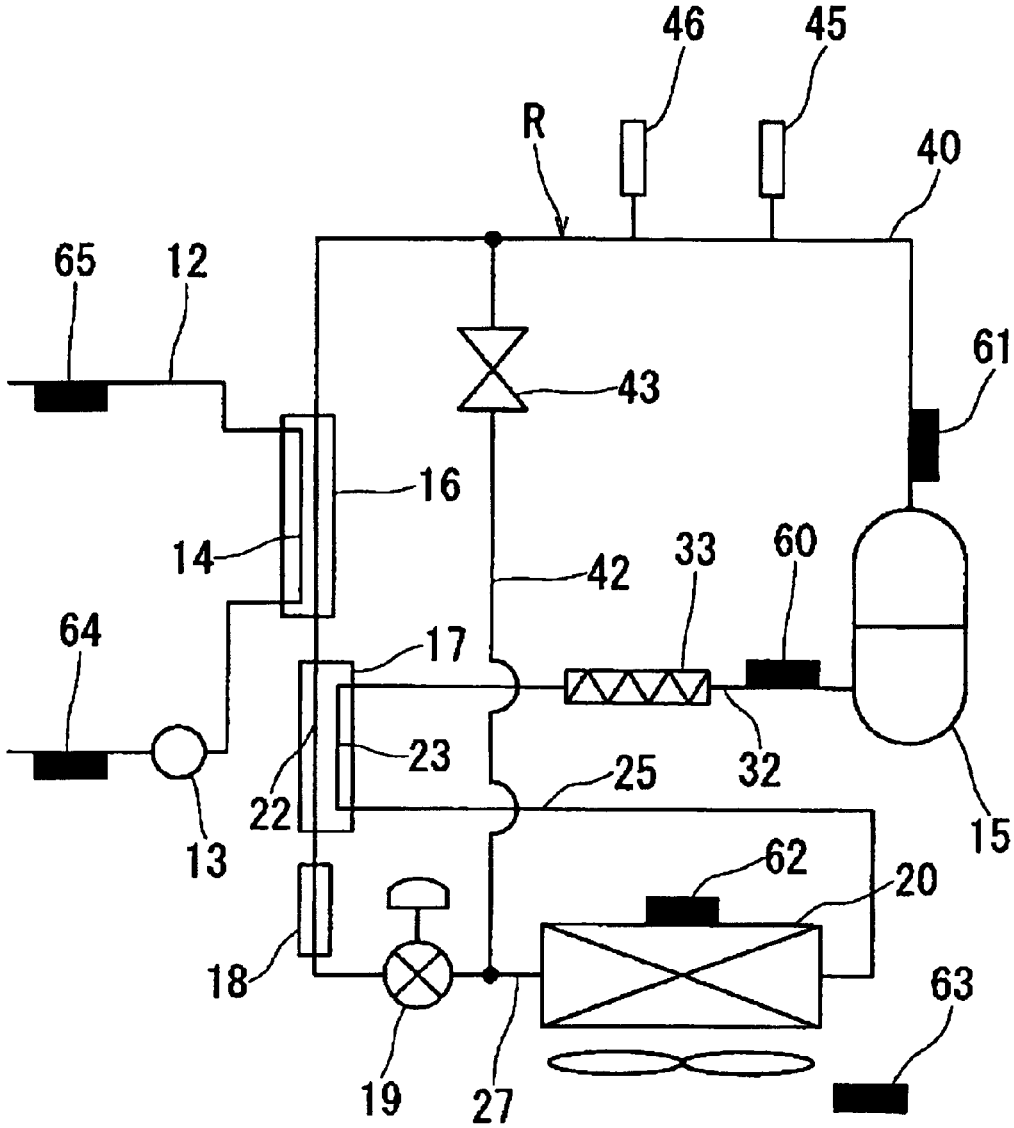
FIG. 20 is a simplified diagram showing a sixth embodiment of the refrigerant circuit of the present invention.
Figure 21:
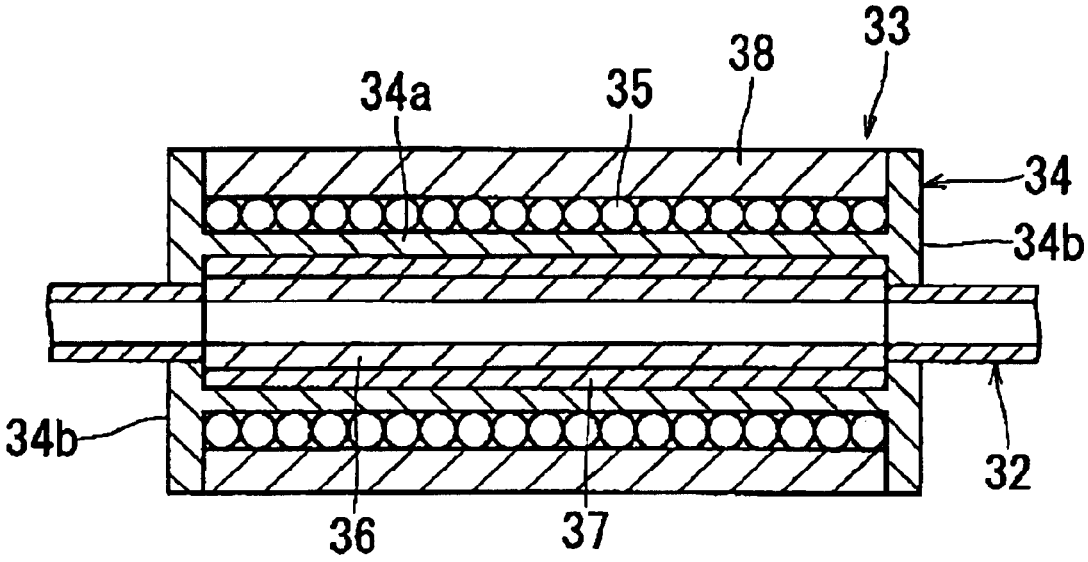
FIG. 21 is a cross sectional view of a heating means of the refrigerant circuit.

To cope with the above problems, it is preferable that a heating means 33 for liquid back prevention is disposed in a refrigerant suction path 32 (which is a flow path of the refrigerant flow path 25 extending from the cooling section 17 to the compressor 15) of the compressor 15, as shown in FIG. 20. In this case, the heating means 33 is implemented by an electromagnetic induction heater, and comprises a bobbin 34 and an electromagnetic induction heating heater (coil) 35 which is wound around the bobbin 34, as shown in FIG. 21. Stated another way, the bobbin 34 is made up of a tubular part 34*a* and outer collar parts 34*b* and 34*b* formed continuously to both ends of the tubular part 34*a*, and the electromagnetic induction heating heater 35 is wound around the tubular part 34*a*.

And, an iron pipe 36 and an insulating material 37 with which to cover the iron pipe 36 are internally fitted in the tubular part 34*a* and an insulating material 38 is externally fitted around the electromagnetic induction heating heater 35. And, the iron pipe 36 constitutes a part of the refrigerant suction path 32. Additionally, the heating means 33 has a power supply (not shown) for supplying electric power to the electromagnetic induction heating heater 35. When electric power is supplied from the power supply to the electromagnetic induction heating heater 35, numerous eddy currents are generated in the iron pipe 36, whereby the iron pipe 36 is heated. As a result, refrigerant flowing in the iron pipe 36 is heated.

Furthermore, the control section of the refrigerant circuit R has a control means (not shown) for controlling the heating means 33. In other words, as shown in FIG. 20, thermistors 60 and 61 are disposed in the vicinity of a suction port of the refrigerant suction path 32 and in the vicinity of a discharge port of the refrigerant discharge path 40, respectively. The evaporator 20 is provided with an evaporator thermistor 62. Based on the action of the evaporator thermistor 62 and on the action of the thermistor 60 of the refrigerant suction path 32, it is determined whether liquid back to the compressor 15 will occur or not. And, if there is the possibility of the occurrence of liquid back, electric power is supplied to the heating means 33 so that refrigerant in the refrigerant suction path 32 is heated. In FIG. 20, reference numeral 63 denotes an outside air thermistor. Although their diagrammatic representation is omitted, the thermistors 60, 61, 62, 63 are provided also in each of the refrigerant circuits R, for example in the refrigerant circuit R of FIG. 1.

To sum up, in the refrigerant circuit shown in FIG. 20, in the transition period such as defrost operation and defrost return, the heating means 33 is operated by the control means so that refrigerant in the refrigerant suction path 32 is heated, thereby preventing the occurrence of liquid back to the compressor 15. The provision of the heating means 33 makes it possible to prevent the occurrence of liquid back without having to provide an accumulator, thereby both reducing costs and preventing the drop in COP due to the suction pressure loss. Besides, the cause of generation of abnormal noise is eliminated, thereby achieving quiet operations.

Figure 22:
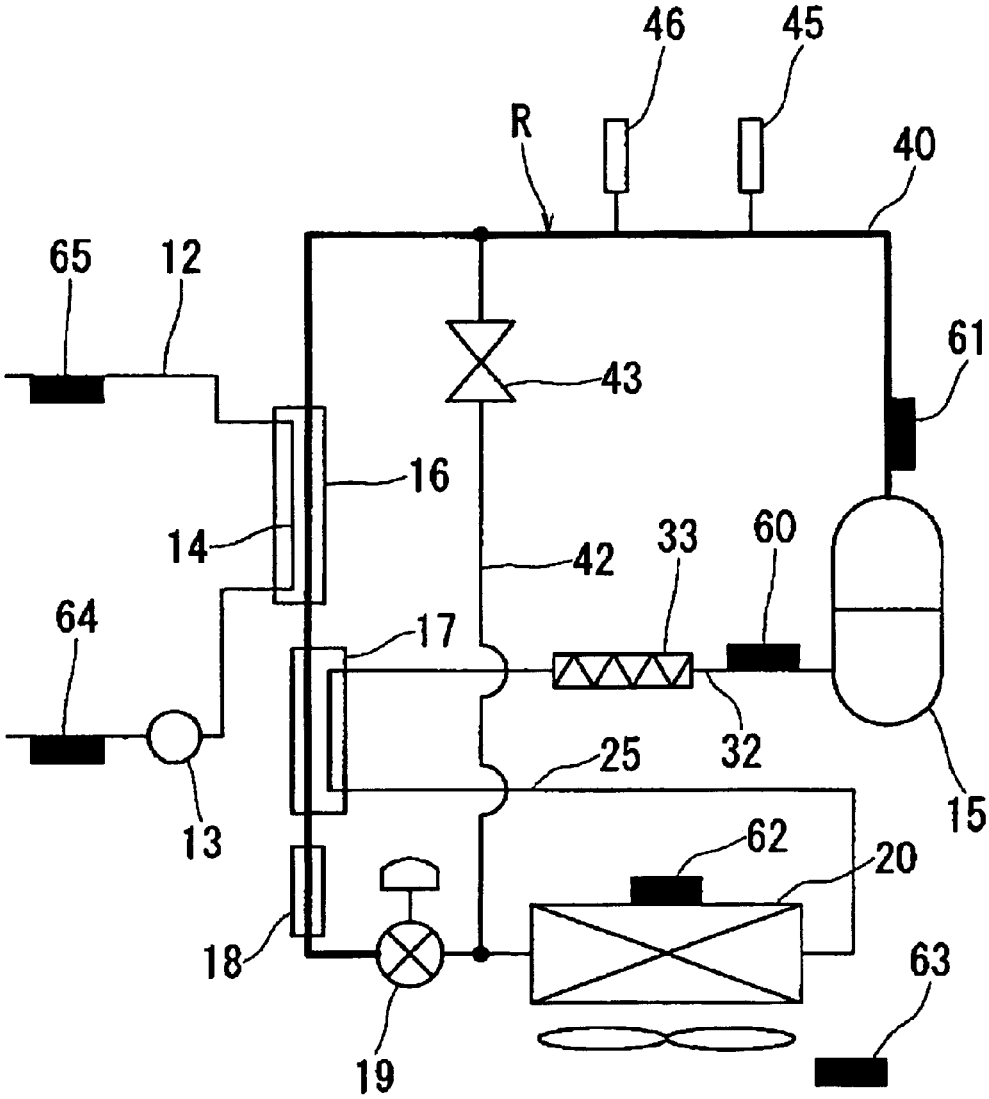
FIG. 22 is a simplified diagram showing a state at the time when the refrigerant circuit is activated.

Furthermore, in this case, the heating means 33 is implemented by an electromagnetic induction heater, which provides advantages such as cleanliness, safety and high heat efficiency. And now, if, in the refrigerant circuit R, either the expansion valve 19 which is an electric valve is fully closed or the valve travel of the expansion valve 19 is less than a predetermined value for a given length of time from the activation of the compressor 15, this makes it possible to prevent the occurrence of abrupt liquid back of the refrigerant present in a heavy-line part (high pressure part) of FIG. 22 toward the compressor 15.

Figure 23:
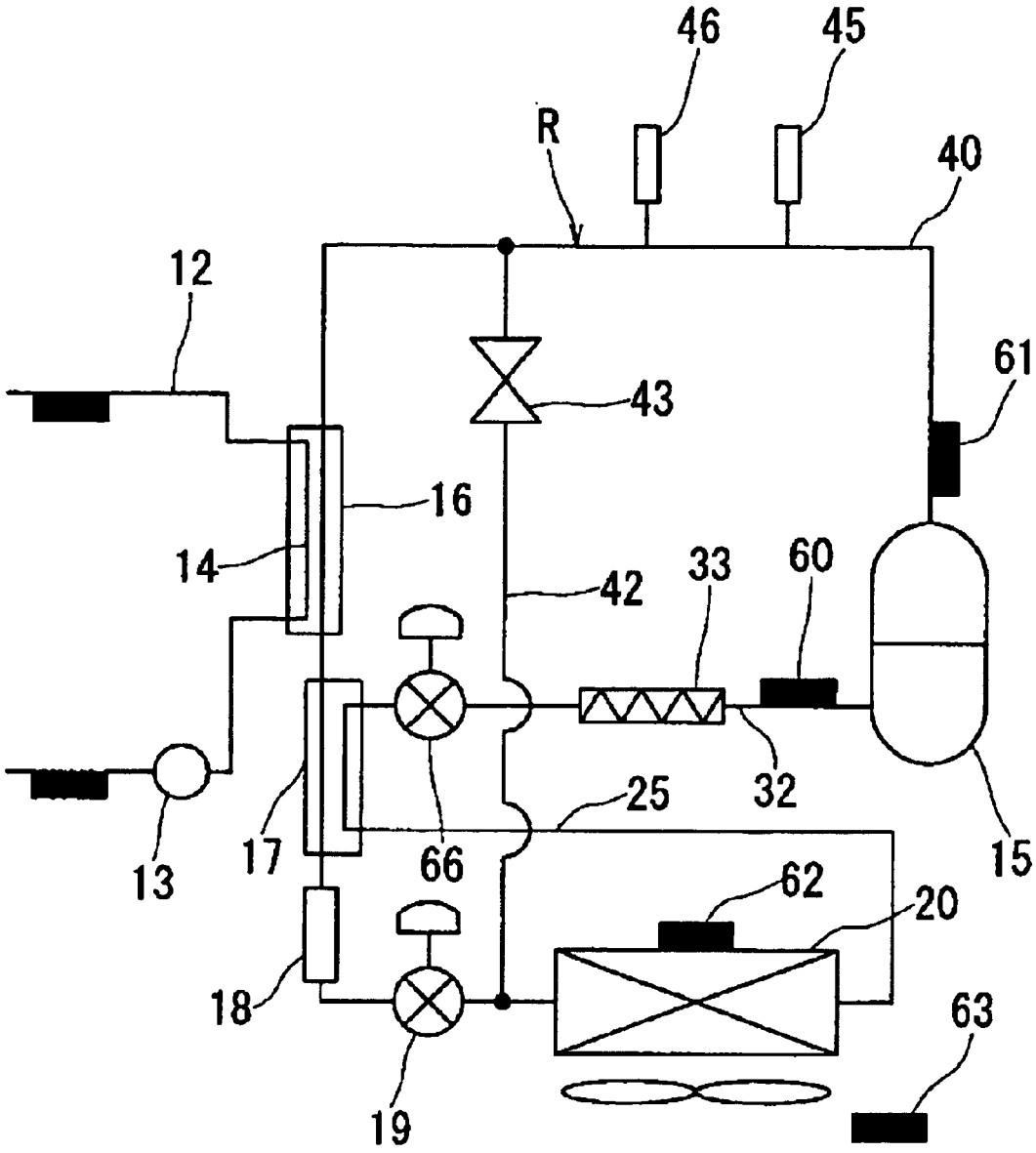
FIG. 23 is a simplified diagram showing a seventh embodiment of the refrigerant circuit of the present invention.

In addition, in a refrigerant circuit R of FIG. 23, a control valve 66 which is an electric valve for flow rate control is inserted upstream of the heating means 33 in the refrigerant suction path 32. In other words, in the refrigerant circuit R of FIG. 23, by reducing the valve travel of the control valve 66 in the transition period such as operation activating time, defrost operation starting time, defrost operation time, and defrost return time, the flow rate is restricted, and, at the same time, heating is carried out by the heating means 33, for preventing the occurrence of liquid back. This more reliably achieves liquid back prevention.

Figure 24:
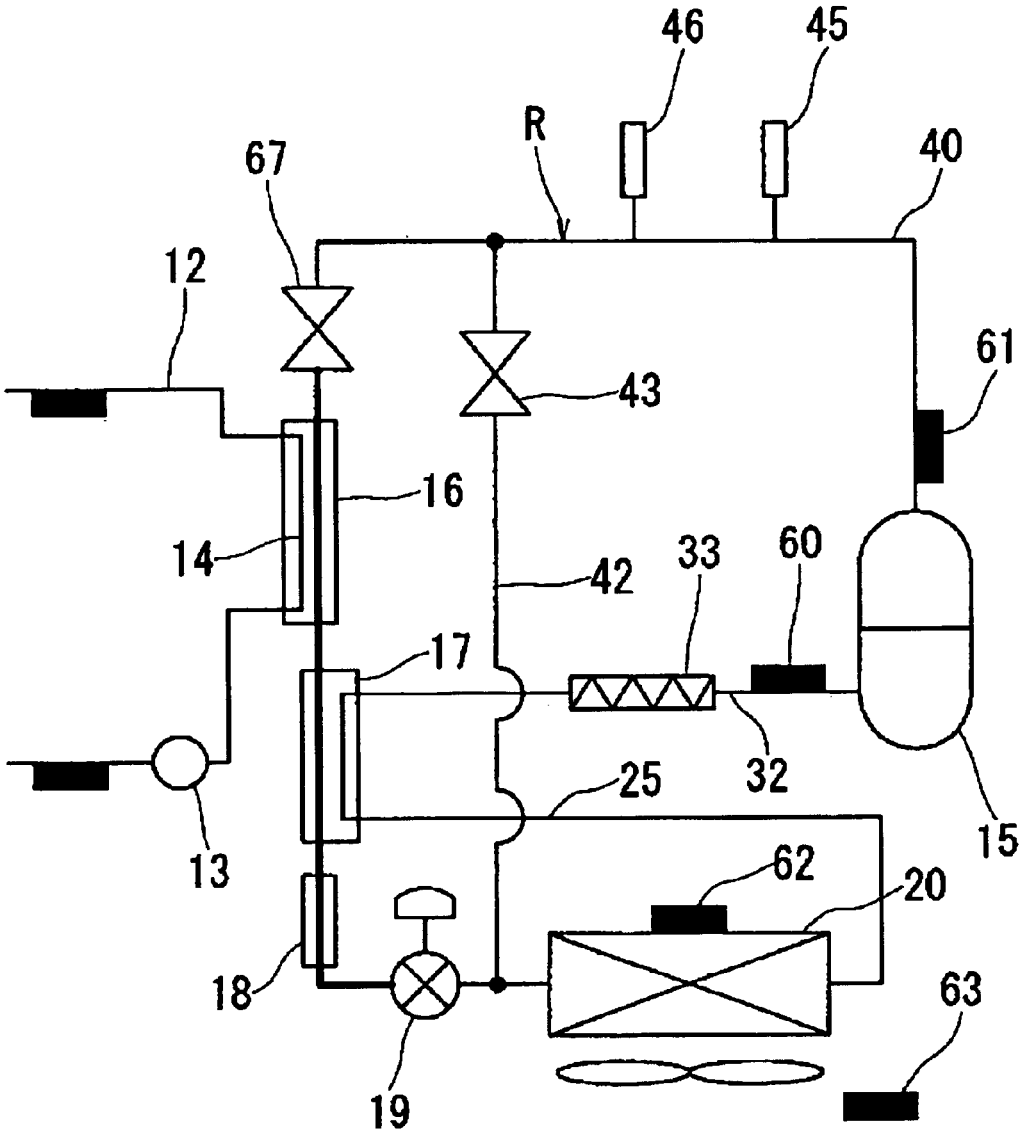
FIG. 24 is a simplified diagram showing an eighth embodiment of the refrigerant circuit of the present invention.

Referring next to FIG. 24, there is shown a refrigerant circuit R in which a liquid back preventing valve 67 which is an electromagnetic valve is disposed interposingly between the compressor 15 and the condenser 16. In this case, for a given length of time from the activation of the compressor 15 or during the defrost operation, either the expansion valve 19 which is an electric valve is fully closed or the valve travel of the expansion valve 19 is set less than a predetermined value while at the same time the liquid back preventing valve 67 which is an electromagnetic valve is placed in the closed state. This therefore makes it possible to prevent the occurrence of abrupt liquid back of the refrigerant present in a heavy-line part (high pressure part) (the range from the liquid back preventing valve 67 to the expansion valve 19) to the compressor 15. In addition, also in the refrigerant circuit R of FIG. 24, the heating means 33 is disposed in the refrigerant suction path 32, thereby making it possible to prevent the occurrence of liquid back by heating the refrigerant in the refrigerant suction path 32 with the heating means 33 at the operation activating time or at the defrost operation starting time. Furthermore, also in the refrigerant circuit R shown in FIG. 24, it may be arranged such that the control valve 66 is disposed in the refrigerant suction path 32 and the flow rate is restricted by the control valve 66 in addition to heating by the heating means 33.

Figure 25:
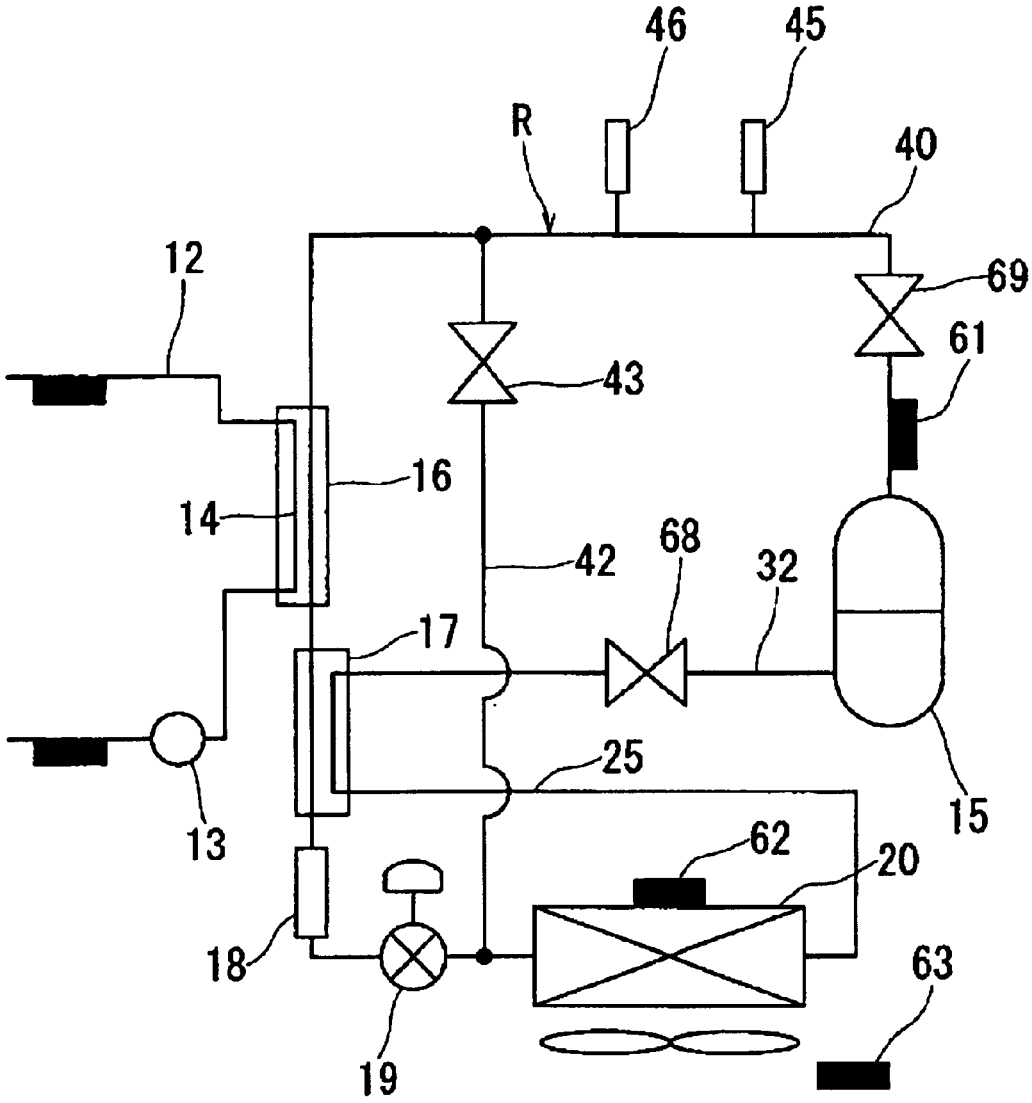
FIG. 25 is a simplified diagram showing a ninth embodiment of the refrigerant circuit of the present invention.

Referring next to FIG. 25, there is shown a refrigerant circuit R in which the heating means 33 is not provided and the refrigerant suction path 32 and refrigerant discharge path 40 of the compressor 15 are provided with for example liquid back preventing valves 68 and 69, respectively, whereby the occurrence of liquid back to the compressor 15 after the operation is brought into a halt is avoided. Stated another way, after the operation is stopped, both the liquid back preventing valves 68 and 69 are placed in the closed state so that refrigerant is prevented from flowing into the compressor 15 through the refrigerant suction path 32 and through the refrigerant discharge path 40, whereby activation defects at the time of the next activation of the compressor 15 and damage to the compressor 15 due to liquid compression are avoided. In addition, also in the refrigerant circuit R of FIG. 25, it may be arranged such that the heating means 33 is disposed in the refrigerant suction path 32 for preventing the occurrence of liquid back to the compressor 15 by heating refrigerant with the heating means 33 in the transition period such as operation activating time, defrost operation starting time, defrost operation time, and defrost return time.

And, the heating means 33, used in the refrigerant circuits such as the one shown in FIG. 20, may be formed by other than an electromagnetic induction heater, in other words the heating means 33 may be formed by an heating element of Nichrome (trademark) element or the like. In addition to the aforesaid liquid back preventing operation, it is preferable that refrigerant in the inside of the compressor 15 is evaporated by performing an open-phase preheating operation of an inverter circuit of the compressor 15 until a predetermined length of time elapses from the time when the compressor 15 is turned on.

In the above, various embodiments of the present invention have been described. However, the present invention is not limited to these embodiments and, therefore, various changes and modifications may be made in the present invention. For example, the present invention is applicable to refrigerant circuits other than the heat pump type hot water supply apparatus. In addition, as the refrigerant, refrigerants used in the super-critical conditions such as ethylene, ethane, nitrogen oxide et cetera may be used in addition to carbon dioxide. The condenser 16 of the present invention is any device having a function of cooling a high temperature, high pressure super-critical refrigerant compressed by the compressor 15 and is called, in some cases, a gas cooler (radiator).

INDUSTRIAL APPLICABILITY

As has been described above, the present invention provides refrigerant circuits useful for hot water supply apparatus. The refrigerant circuits of the present invention are particularly suitable for the case where refrigerant is compressed to above a critical pressure for performing a refrigerant cycle.

What is claimed is:

1. A refrigerant circuit comprising:

a compressor, a radiator, a receiver, an expansion valve, and an evaporator in which refrigerant circulates, said compressor compressing the refrigerant to above a critical pressure for performing a refrigerating cycle, a cooling section being disposed on an upstream side of said receiver to cool the refrigerant flowing out of said radiator, and a part of said evaporator constituting an air heat exchanger with said air heat exchanger operating as said cooling section.

2. The refrigerant circuit of claim 1, wherein said cooling section is operable to transfer heat between the refrigerant flowing out of said radiator and the refrigerant on an outlet side of said evaporator.

3. A refrigerant circuit comprising:

a compressor, a radiator, a receiver, an expansion valve, and an evaporator in which refrigerant circulates, said compressor compressing the refrigerant to above a critical pressure for performing a refrigerating cycle; and a heat exchange device being operable to transfer heat between high pressure refrigerant inside of said receiver and low pressure refrigerant on an inlet side of said evaporator.

4. A refrigerant circuit comprising:

a compressor, a radiator, a receiver, an expansion valve, and an evaporator in which refrigerant circulates, said compressor compressing refrigerant to above a critical pressure for performing a refrigerating cycle, and a bypass circuit being provided through which high pressure refrigerant from said compressor flows into said receiver for transferring heat between said high pressure refrigerant inside of said receiver and low pressure refrigerant on an inlet side of said evaporator.

5. The refrigerant circuit of claim 4, wherein said bypass circuit is provided with a throttle mechanism.

6. The refrigerant circuit of claim 4, wherein a flow rate control valve is disposed on an outlet side of said receiver.

* * * * *